US006402559B1

(12) United States Patent
Marowsky et al.

(10) Patent No.: US 6,402,559 B1
(45) Date of Patent: Jun. 11, 2002

(54) MODULAR ELECTRICAL PLUG, PLUG-CABLE ASSEMBLIES INCLUDING THE SAME, AND LOAD BAR AND TERMINAL BLADE FOR SAME

(75) Inventors: Richard Marowsky, York; Robert Colantuono, Dover; Ronald Locati, York, all of PA (US)

(73) Assignee: Stewart Connector Systems, Inc., Glen Rock, PA (US)

( * ) Notice: Subject to any disclaimer, the term of this patent is extended or adjusted under 35 U.S.C. 154(b) by 0 days.

(21) Appl. No.: 09/578,397

(22) Filed: May 25, 2000

Related U.S. Application Data

(60) Provisional application No. 60/136,178, filed on May 27, 1999.

(51) Int. Cl.[7] ..... H01R 24/00

(52) U.S. Cl. ..... 439/676; 439/460

(58) Field of Search ..... 439/404, 676, 439/678, 344, 660, 638, 354, 541.5, 607, 608, 459, 460, 457, 418, 941

(56) References Cited

U.S. PATENT DOCUMENTS 5,281,170 A * 1/1994 Murphy ..... 439/676
5,571,035 A 11/1996 Ferrill ..... 439/894
5,607,326 A * 3/1997 McNamara et al. ..... 439/607
5,628,647 A 5/1997 Rohrbaugh et al. ..... 439/404
5,888,100 A * 3/1999 Bofill et al. ..... 439/676
6,080,007 A 6/2000 Dupuis et al. ..... 439/418
6,083,052 A * 7/2000 Adams et al. ..... 439/676

* cited by examiner

*Primary Examiner*—Gary Paumen
*Assistant Examiner*—Felix O. Figueroa
(74) *Attorney, Agent, or Firm*—Steinberg & Raskin, P.C.

(57) ABSTRACT

A modular plug including a housing made of dielectric material including a plurality of parallel, spaced, longitudinally extending terminal-receiving slots at a forward end and a longitudinal cavity extending from a rear face thereof forward. Each terminal-receiving slot receives a respective terminal blade. The plug also includes a load bar assembly which is inserted into the cavity and includes a load bar housing defining conductor-receiving channels in substantially parallel rows or levels arranged such that each level receives at least one pair of conductors, preferably a pair of conductors which operatively forming a circuit during use. Preferably, the channels adapted to receive the conductors forming conductor pair #1, conductors 4 and 5 according to a standard convention, and the channels adapted to receive the conductors forming conductor pair #3, conductors 3 and 6, are situated in levels distant from one another to thereby reduce crosstalk between these conductor pairs. The modular plug-cable assembly in accordance with the invention includes a multi-conductor cable and at least one plug as described above terminating a respective end of the cable. The other end of the cable may be unterminated or terminated by a plug as described above or another electrical connector.

20 Claims, 21 Drawing Sheets

FIG.2
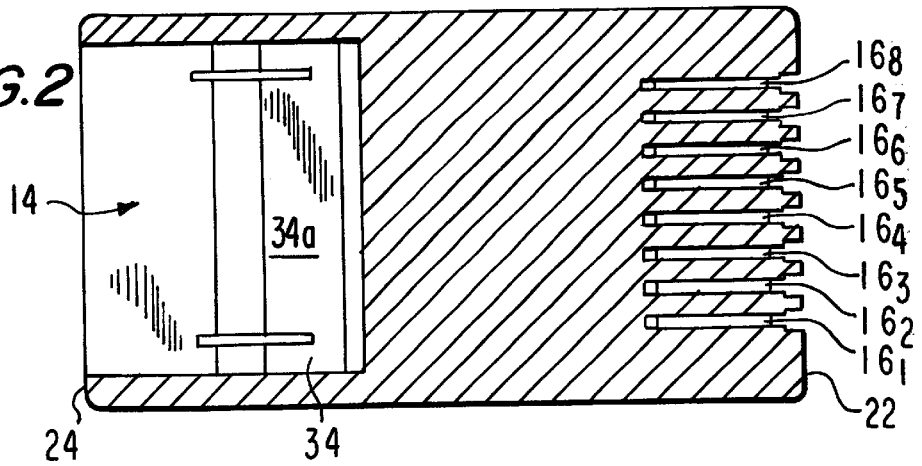
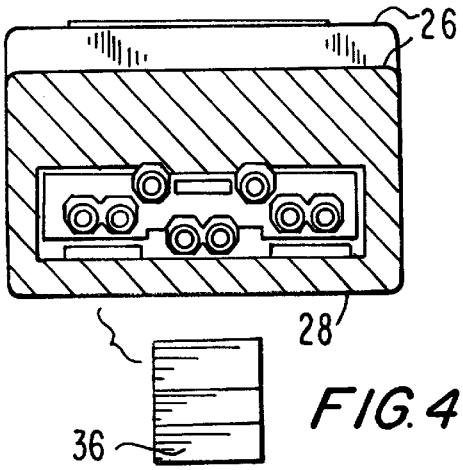
FIG.4
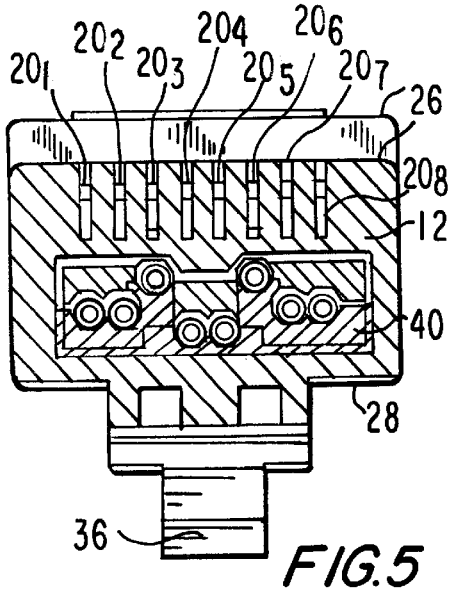
FIG.5
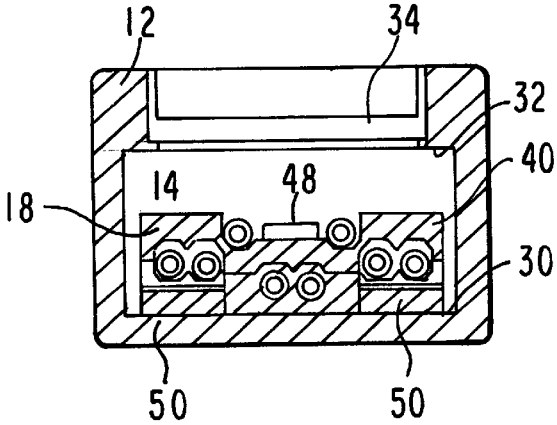
FIG.3

MODULAR ELECTRICAL PLUG, PLUG-CABLE ASSEMBLIES INCLUDING THE SAME, AND LOAD BAR AND TERMINAL BLADE FOR SAME

This application is related to U.S. provisional application Ser. No. 60/136,178, filed May 27, 1999.

FIELD OF THE INVENTION

This invention relates generally to modular electrical plugs and, more particularly, to a modular plug having performance properties which will be in compliance with Category 6 standards.

The present invention also relates to plug-cable assemblies of a multi-conductor cable and a plug at one end terminating the cable and a plug or other electrical connector terminating the other end of the cable, or the other end being unterminated.

The present invention also relates to a load bar and a terminal blade for a modular electrical plug.

BACKGROUND OF THE INVENTION

In view of the continual desire to increase the transmission rate of data through electrical cables, new performance standards are being promulgated for modular electrical connectors. Connectors having characteristics in compliance with this standard will be known as Category 6 connectors, or Cat 6 connectors for short.

Although existing modular connectors such as jacks and plugs, e.g., those having characteristics in compliance with the immediate lower standards (Category 5), might be found to be in compliance with Category 6 standards as well, it is advantageous to develop new modular connectors designed specifically to comply with Cat 6 standards.

Cat 6 modular jacks and plugs are intended to be used in data communication networks to enable the flow of information at higher transmission rates than currently available with known modular connectors, including Cat 3 and Cat 5 connectors. However, data transmitted at high rates in multipair data communication cables has an increased susceptibility to crosstalk, which often adversely affects the processing and integrity of the transmitted data. Crosstalk occurs when signal energy "crosses" from one signal pair to another. The point at which the signal crosses or couples from one set of conductors to another may be 1) within the connector or internal circuitry of the transmitting station, referred to as "near-end" crosstalk, 2) within the connector or internal circuitry of the receiving station, referred to as "far-end crosstalk", or 3) within the interconnecting cable.

Near-end crosstalk ("NEXT") is especially troublesome in the case of telecommunication connectors of the type specified in sub-part F of FCC pan 68.500, commonly referred to as modular connectors. The EIA/TIA (Electronic/Telecommunication Industry Association) of ANSI has promulgated electrical specifications for near-end crosstalk isolation in network connectors to ensure that the connectors themselves do not compromise the overall performance of the unshielded twisted pair (UTP) interconnect hardware typically used in LAN systems. It is expected that electrical specifications for Cat 6 plugs will also be promulgated in the near future.

In the prior art, reference is made to the assignee's U.S. Pat. No. 5,628,647 (Rohrbaugh et al., incorporated by reference herein) which describes Cat 5 modular plugs including a management bar or load bar for receiving the conductors in separate conductor-receiving passages or channels. Inter-conductor capacitance in the plugs is reduced by offsetting adjacent conductors, i.e., vertically spacing adjacent conductors from one another, such that the conductor-receiving channels, and thus the conductors, are arranged in two planar arrays spaced one above the other. The offset conductors help to lower the plug's internal capacitance thus enabling compliance with, for the disclosed plugs, Cat 5 standards.

OBJECTS AND SUMMARY OF THE INVENTION

It is an object of the present invention to provide new and improved modular plugs and modular plug-cable assemblies including the same.

It is another object of the present invention to provide new and improved modular plugs and modular plug-cable assemblies including the same in compliance with Category 6 standards.

It is yet another object of the present invention to provide new and improved designs of modular plugs offering crosstalk performance better than that of existing modular plugs.

It is still another object of the present invention to provide a new and improved conductor management bar or load bar for use in modular electrical plugs.

It is another object of the present invention to provide new and improved terminal blades for use in modular electrical plugs.

Briefly, in accordance with the present invention, these and other objects are achieved by providing a modular plug including a plug housing made of dielectric material including a plurality of parallel, spaced, longitudinally extending terminal-receiving slots at a forward end and a longitudinal cavity extending from a rear face thereof forward to a location below the slots such that the cavity is in communication with the slots. Each terminal-receiving slot receives a respective terminal blade or insulation displacing contact. The plug also includes a conductor management bar, or load bar, arranged in the cavity and defining conductor-receiving channels in which the two channels receivable of the conductors forming conductor pair #3, i.e., conductors 3 and 6 according to TIA/EIA-ANSI standard 568B, are located in a first row or level while the two channels receivable of the conductors forming conductor pair #1, i.e., conductors 4 and 5 according that standard, are located in a second row or level substantially parallel to and spaced from the first level. Preferably, the channels receivable of conductors 4 and 5 are spaced laterally inwardly, i.e., between the channels receivable of conductors 3 and 6.

In a first preferred embodiment comprising an 8-position plug (terminating four twisted wire pairs), the conductor-receiving channels are located in three substantially parallel rows or levels arranged such that each level receives at least one pair of conductors operatively forming a circuit during use. The channels adapted to receive the conductors forming conductor pair #1, conductors 4 and 5, and the channels adapted to receive the conductors forming conductor pair #3, conductors 3 and 6, are situated in the levels most distant from one another to thereby reduce crosstalk between these conductor pairs. The two additional pairs of channels are situated at a third intermediate level between the first and second levels.

More particularly, according to a first embodiment of the invention, the load bar housing includes first (or rearward), second (or intermediate) and third (or forward) longitudinally adjoining portions, the third portion being situated below the contact-receiving slots and each portion having a different transverse cross-sectional form, although the load bar housing is a unitary member. At one (a top) level, two channels are formed from, a longitudinal indentation or trough on an upper surface of the first (or rearward) portion, a shaped cavity or bore in the second or intermediate portion and a longitudinal indentation or trough on an upper surface of the third portion). A groove is provided in the first and second portions to receive a conductive strip and hold the conductive strip between the channels in the first level and thereby correct an impedance problem arising from the horizontal separation of the conductors received in the channels in this level. At a second (a bottom) level, two channels are formed from a respective longitudinal indentation on a lower surface of the first portion, a shaped cavity in the second portion and a respective indentation on an upper surface of the third portion. At a third (an intermediate) level, two additional pairs of channels are formed within the load bar housing and between the first and second levels. The load bar assembly preferably comprises means for distributing crosstalk between the pairs of conductors received in the channels in the third level and the pairs of conductors received in other channels and operatively forming a circuit during use, i.e., conductive strips situated alongside the channels.

The conductive strips may be strips of metallic material such as copper, strips of conductive plastic, strips of insert molded plastic surrounding a metal strip or an electroplated strip of plastic, i.e., plastic overlaid with metal.

A second embodiment of the invention comprises an 8-position plug that does not require three separate levels of conductor-receiving channels in the plug housing. According to the second embodiment, the load bar assembly includes a load bar housing defining a plurality of longitudinally-extending conductor-receiving channels for receiving conductors of the cable in which, like the case of the first embodiment, the two channels receivable of the conductors designated 3 and 6 forming conductor prior #3 are located in a first top row or level while the two channels receivable of the conductors 4 and 5 forming conductor pair #1 are located in a second or bottom row or level substantially parallel to and spaced from, and are between the channels in, the first level and between the channels in the first level. The second embodiment differs from the first embodiment in that two additional pairs of channels receivable of the other conductors forming the other two conductor pairs are situated in the same level as that in which the channels receivable of conductors 4 and 5 forming conductor pair #1 are located, i.e., the bottom level. The load bar housing of this embodiment also includes three longitudinally adjoining portions, and the channels are formed in the load bar housing by an arrangement of indentations or troughs and shaped cavities or bores similar, but not identical to the arrangement in the first embodiment. An elongate conductive strip arranged between two channels receiving two conductors operatively forming a circuit during use. The load bar housing preferably also includes a groove parallel to and between these two channels in which the conductive strip is arranged.

In another embodiment of the plug in accordance with the invention which does not require three separate levels of conductor-receiving channels in the plug housing (although it is a preferred construction), the plug includes a housing defining a plurality of terminal-receiving slots and a longitudinal cavity extending from a rear surface of the housing, terminal blades arranged in the slots and a load bar assembly including a load bar housing defining a plurality of conductor-receiving channels for receiving the conductors of the cable and guiding the conductors to a location below the slots such that the terminal blades are displaceable to penetrate the conductors when the conductors are received in the channels. Further, the load bar assembly includes means for distributing, within the pair of conductors received in one pair of channels and operatively forming a circuit during use, crosstalk generated between that pair of conductors and pairs of conductors received in other channels. The longitudinal cavity may extend from the rear surface of the housing to a location below the slots and be in communication with the slots whereby the load bar assembly would extend in the cavity to a location below the slots.

The modular plug-cable assembly in accordance with the invention includes a multi-conductor cable and at least one plug as described above terminating a respective end of the cable. The other end of the cable may be terminated by a plug as described above or another electrical connector, or left unterminated. In the latter case, the purchaser of the plug-cable assembly could terminate the unterminated end as desired.

A load bar for a modular plug in accordance with the invention includes a unitary housing defining a plurality of channels arranged in at least two substantially parallel levels whereby each level includes at least two channels. The housing is elongate and includes first, second and an optional third longitudinally adjoining portions each having a different cross-sectional form. In a first three-level 8-position embodiment, each of two channels for receiving conductors 3 and 6 of conductor pair #3 are defined by a longitudinal indentation on an upper surface of the first portion, a cavity in the second portion and an indentation on an upper surface of the third portion and these channels constitute a first level of channels. The housing also preferably includes retaining means for retaining at least one conductive strip, e.g., a groove arranged between the channels in the first portion and the cavities in the second portion. Two additional channels for receiving conductors 4 and 5 of conductor pair #1 are defined by a respective longitudinal indentation on a lower surface of the first portion, a cavity in the second portion and a respective indentation on an upper surface of the third portion and constitute a second level of channels. These channels are preferably arranged between the channels in the first level in a transverse direction of the housing. Further, for the third level, two additional pairs of channels are situated at a common level between the first and second levels of channels. The housing preferably includes means for retaining at least one conductive strip between the channels for conductors forming a circuit pair, such as two pair of longitudinally-extending grooves formed in the first and second portions alongside the channels in the third level.

In a second two-level 8-position embodiment of the load bar, each of two channels for conductors 3 and 6 of pair #3 are defined at a first or upper level by a longitudinal indentation or trough extending on an upper surface of a first portion and extending partially into the second portion, a shaped cavity or bore extending through the remainder of the second portion and an indentation or trough extending on the upper surface of the third portion. Similar conductive strip retaining means are provided for retaining a conductive strip between the two channels in the upper level. Each of two additional channels for receiving conductors 4 and 5 of conductor pair #1 are defined at a second or bottom level by a shaped cavity or bore extending through the first and second housing portions and an aligned indentation or trough extending on the upper surface of the third portion. These channels are preferably arranged between the channels in the first level in a transverse direction of the housing. Further, two additional pairs of channels for the conductors of pairs #2 and #4 are situated in the second or bottom level. These channels are also formed by shaped cavities or bores extending through the first and second housing portions and aligned indentations or troughs extending on the upper surface of the third portion.

A terminal blade for a modular plug in accordance with the invention comprises a flat conductive member having a first portion having an upper edge surface adapted to contact a contact of a mating electrical connector, a second portion adjoining the first portion and having a narrow length than the first portion and a third portion adjoining the second portion and having insulation-piercing tines. A notch is defined in the upper surface to partition the upper surface into two sections, each defining a side of the notch.

BRIEF DESCRIPTION OF THE DRAWINGS

A more complete appreciation of the present invention and many of the attendant advantages thereof will be readily understood by reference to the following detailed description when considered in connection with the accompanying drawings in which:

FIG. 2 is a cross-sectional view of the plug shown in FIG. 1 taken along the line 2—2 of FIG. 1;

FIG. 3 is a cross-sectional view of the first three-level embodiment of the plug shown in FIG. 1 taken along line 3—3 of FIG. 1;

FIG. 4 is a cross-sectional view of the first embodiment of the plug shown in FIG. 1 taken along the line 4—4 of FIG. 1;

FIG. 5 is a cross-sectional view of the first embodiment of the plug shown in FIG. 1 taken along the line 5—5 of FIG. 1;

FIGS. 12*a*–14*a* are views of the second two-level embodiment of a load bar assembly in accordance with the invention corresponding to the views of the first embodiment of FIGS. 12–14;

FIGS. 17*a*–22*a* are views of the second two-level embodiment of a load bar assembly in accordance with the invention corresponding to the views of the first embodiment of FIGS. 17–22.

DETAILED DESCRIPTION OF THE PREFERRED EMBODIMENT

Figure 1:
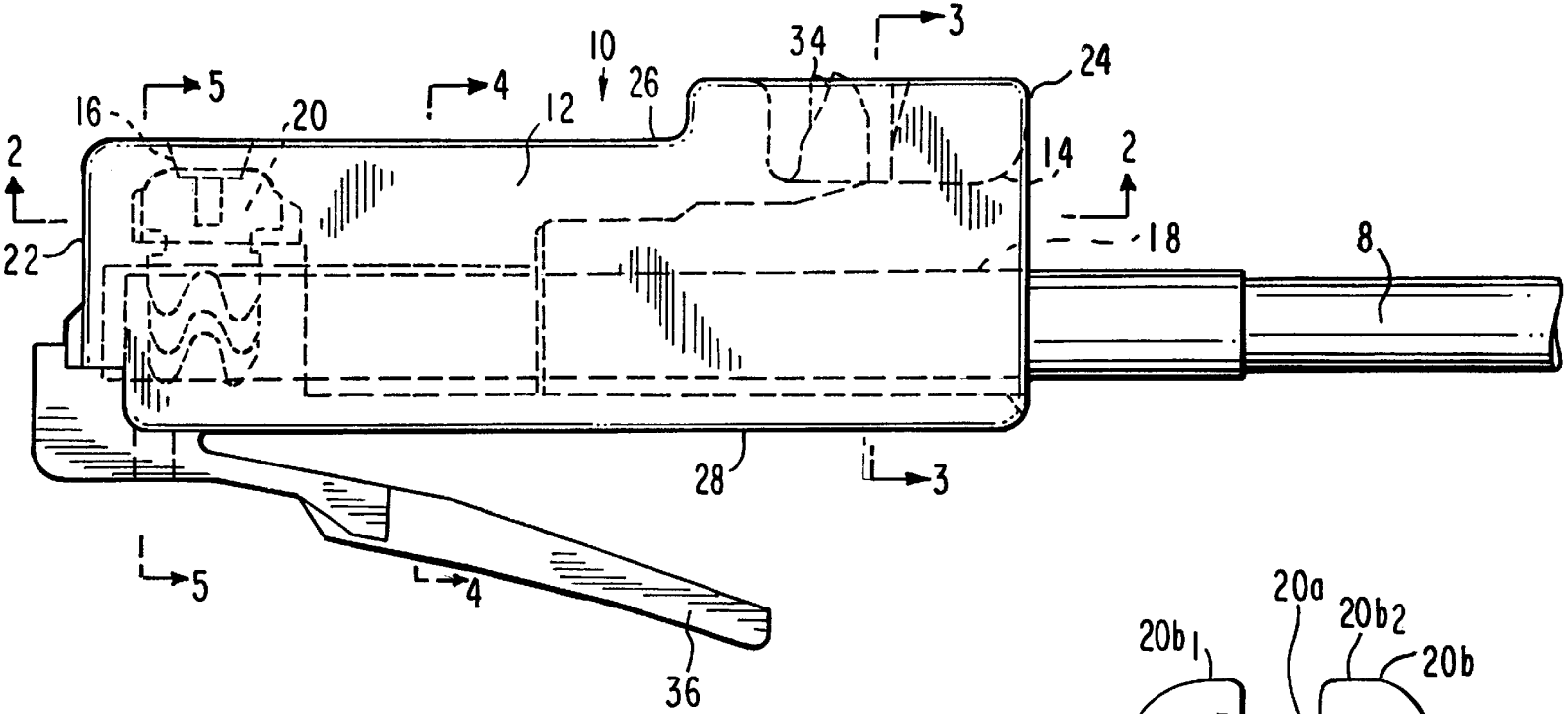
FIG. 1 is a side view in partial section of a first three-level embodiment of a modular plug in accordance with the invention terminating a cable.

Referring now to the drawings wherein like reference characters designate identical or corresponding parts throughout the several views, a modular plug in accordance with the present invention is designated generally as 10 and comprises a plug housing 12 defining a longitudinal cavity 14 opening at a rear face and terminal-receiving slots 16 at the front end, a management bar or load bar assembly 18 arranged in the cavity 14 of the plug housing 12 and including channels 44 for receiving conductors of a cable 8 terminated by the plug 10, and a plurality of terminal blades or insulation displacing contacts 20 arranged in terminal-receiving slots 16 in the plug housing 12.

Plug 10 has the dimensions of a standard RJ45 plug adapted to terminate an eight-conductor cable 8, i.e., eight terminal-receiving slots 16 each containing a terminal blade 20 (FIG. 2). However, it is within the scope of the invention that the dimensions of the plug 10 may be other than that of an RJ45 plug and/or the construction of the plug may be such that it is adapted to terminate a cable having a different number of conductors.

Each terminal blade 20 may have the form disclosed in the assignee's U.S. Pat. No. 4,679,878 (Volk), incorporated by reference herein. In the alternative, one or more of the terminal blades 20 may have the form shown in FIG. 1A. As shown in FIG. 1A, the terminal blade 20 includes a notch 20*a* formed in the upper edge surface 20*b* to thereby partition the upper edge surface into two sections 20*b*1, 20*b*2. The depth and width of the notch 20*a* may vary from that shown but must be selected in consideration of maintaining the functionality of the terminal blade 20. The purpose of the notch 20*a* is to lower the capacitance of the terminal blade 20 by reducing its side surface area by virtue of the presence of the notch 20*a*. It is important though that the notch 20*a* partition the upper edge surface 20*b* into sections so that at least two sections of the upper edge surface remain because the two sections 20*b*1,20*b*2 of the upper edge surface 20*b* enable the use of conventional tooling for pressing the terminal blades 20 into the conductors during termination of a cable by the plug.

Figure 8:
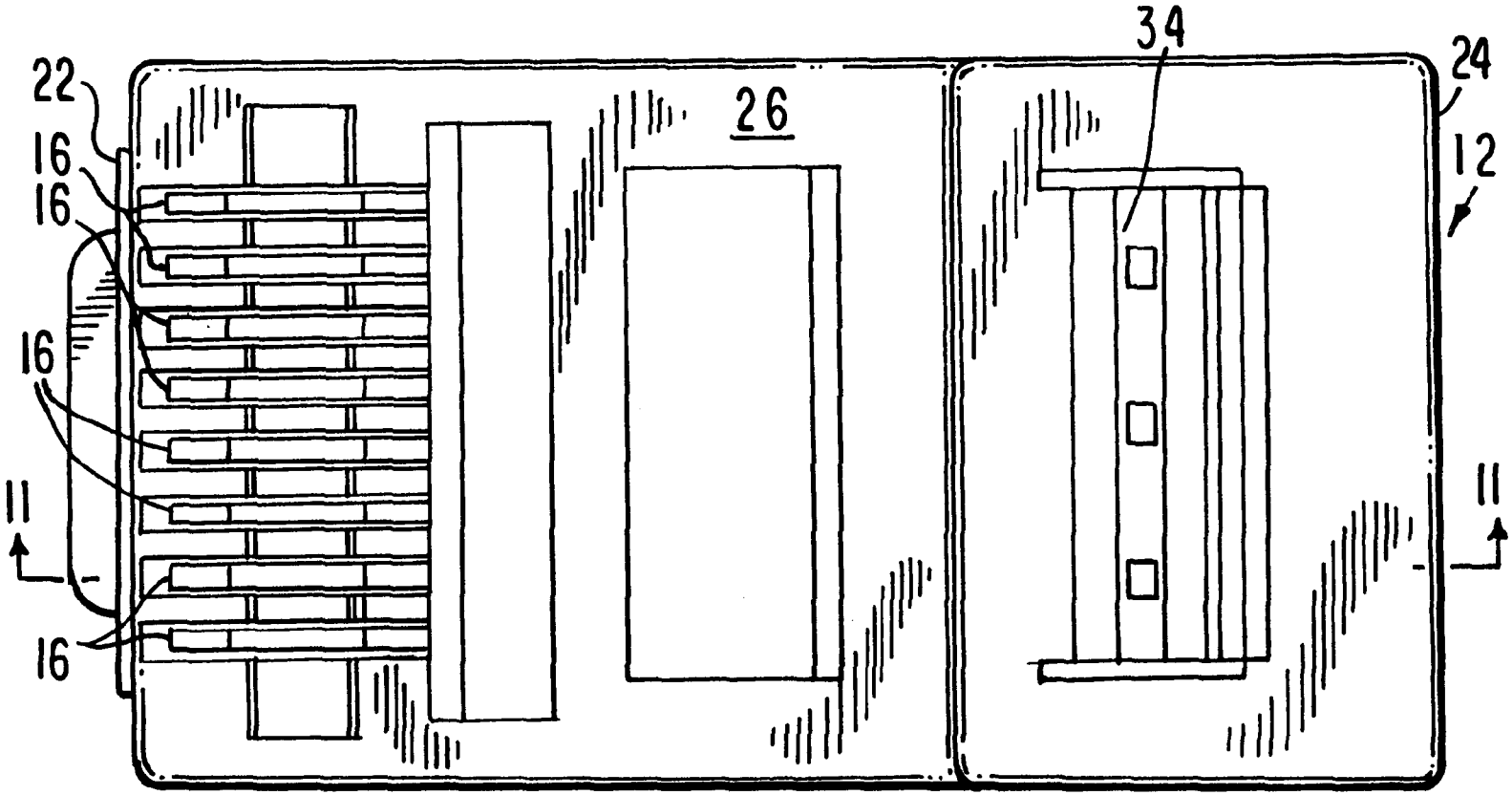
FIG. 8 is a top view of the plug housing shown in FIG. 6, a top view of a plug of the second embodiment being substantially the same.
Figure 9:
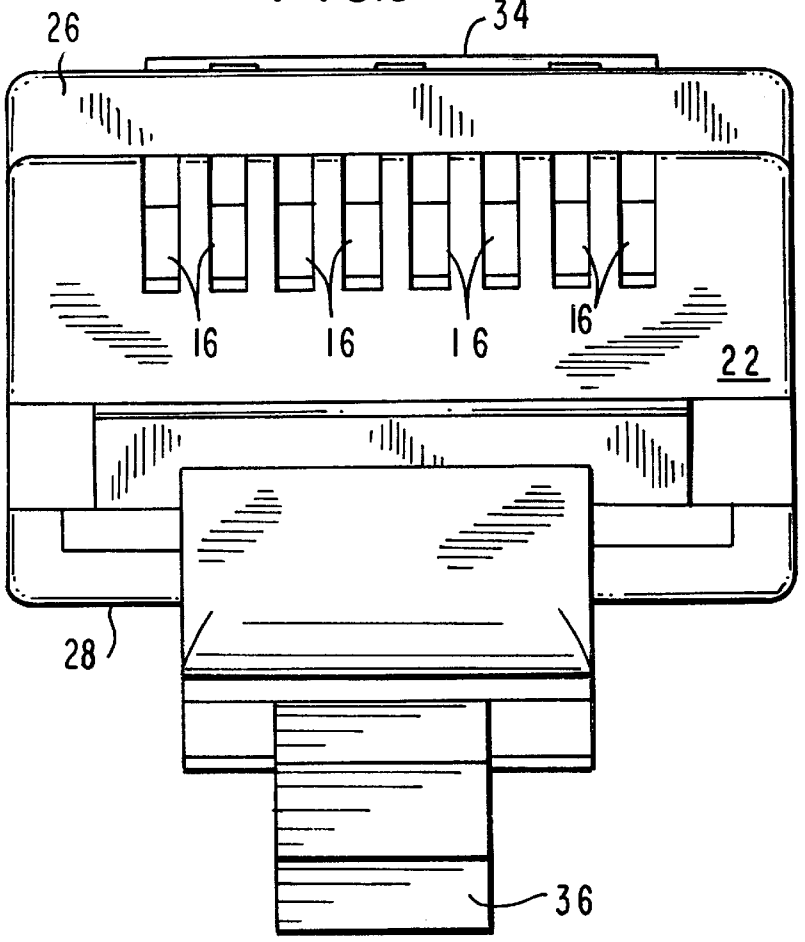
FIG. 9 is a front view of the plug housing shown in FIG. 6, a front view of a plug of the second embodiment being substantially the same.
Figure 10:
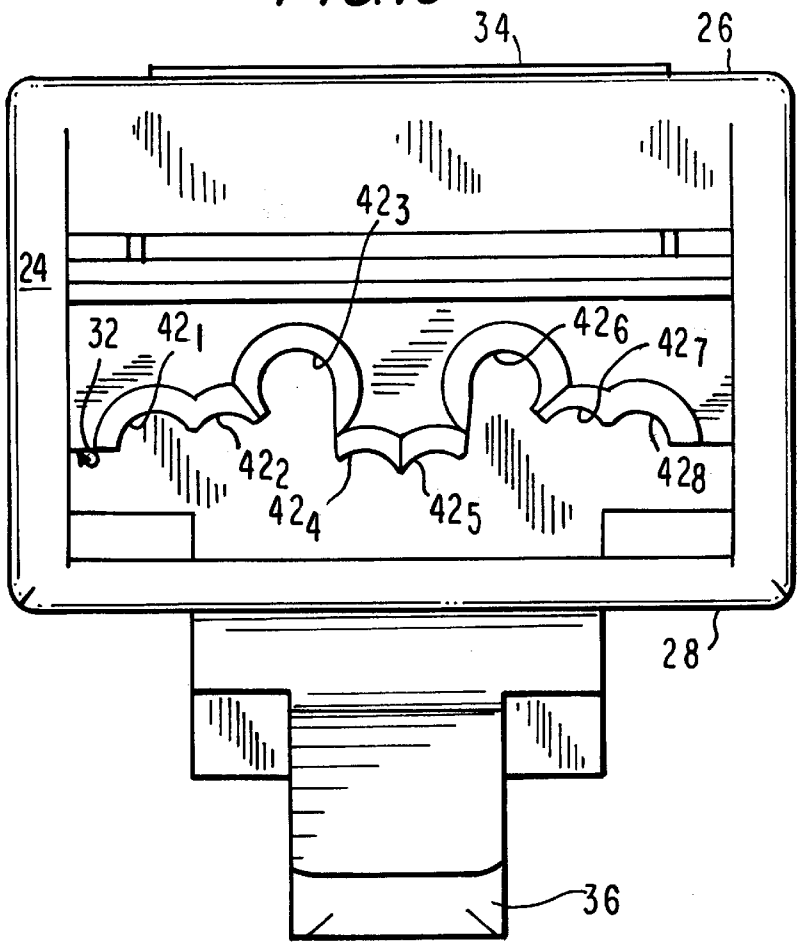
FIG. 10 is a rear view of the plug housing of the first three-level embodiment of the invention.
Figure 11:
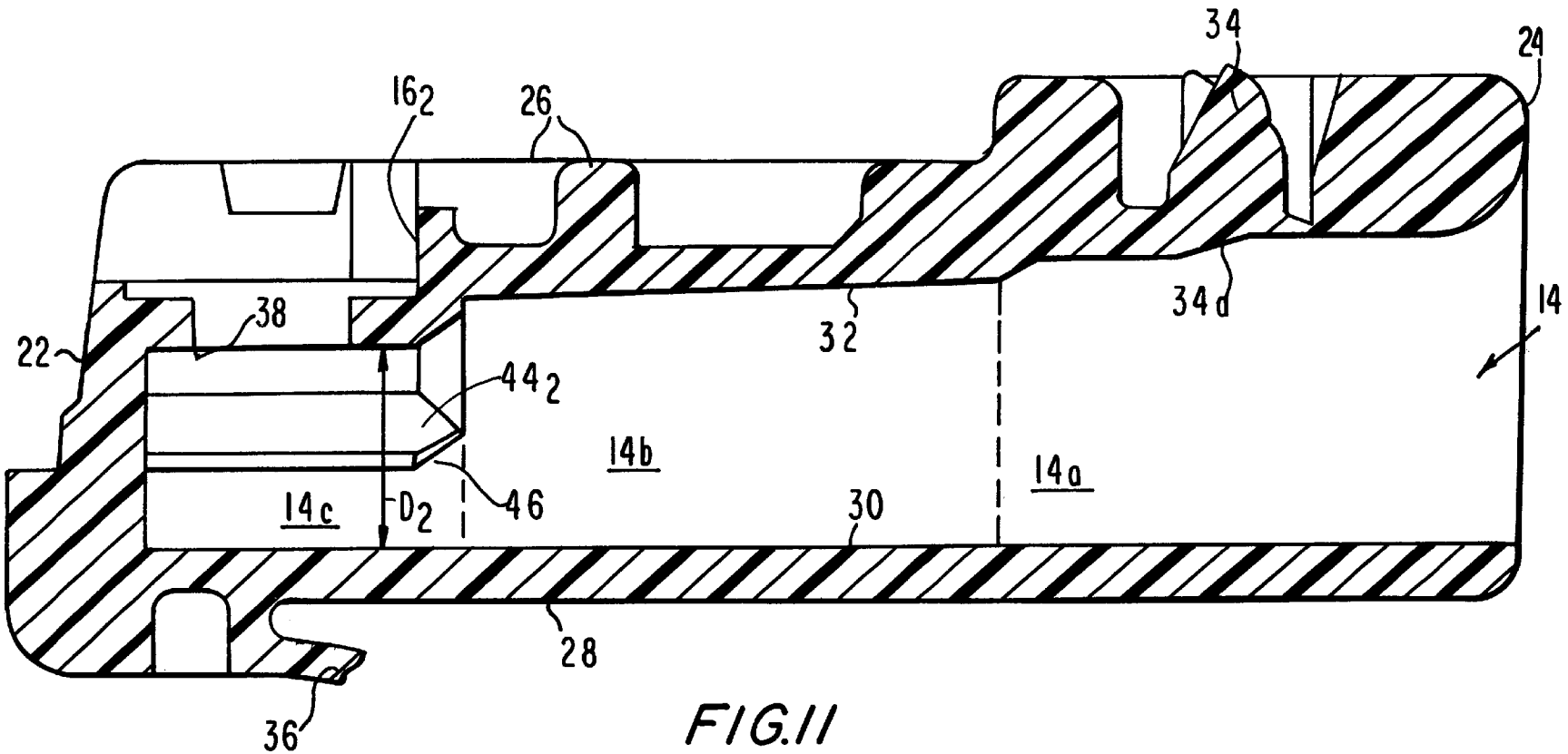
FIG. 11 is a cross-sectional view of the plug housing of the first embodiment shown in FIG. 6 taken along the line 11—11 of FIG. 8.

The plug housing 12 is shown in detail in FIGS. 6–12. Plug housing 12 has a front face 22, a rear face 24, a top face 26, and a bottom face 28, the longitudinal cavity 14 opening into the rear face 24. Plug housing 12 also includes a strain relief element 34 formed in conjunction with the top face 26 and a latch 36 projecting from the bottom face 28 for enabling mating with another electrical connector such as a modular jack. The terminal-receiving slots 16 are formed at the front of the plug housing 12 parallel to and spaced from one another and extend downward from the top face 26 (FIGS. 8 and 11).

As shown in FIG. 11, cavity 14 in the plug housing 12 has a particular shape to accommodate the load bar assembly 18. Specifically, in a longitudinal direction of the plug housing 12, cavity 14 has a rearward portion 14*a* having a substantially rectangular cross-section adapted to receive a rearward end of the load bar assembly 18, an intermediate portion 14*b* immediately inward of the rearward portion 14*a* and a forward portion 14*c* situated below the terminal-receiving slots 16 (FIG. 11). The intermediate and forward portions 14*b*,14*c* of the cavity 14 are constructed to receive a forward end of the load bar assembly 18. While an interior surface 30 of the plug housing 12 defining a bottom surface of the cavity 14 is generally planar, the shape and orientation of an interior surface 32 defining an upper surface of cavity 14 vary between the portions 14*a*,14*b*,14*c*. In the rearward portion 14*a* of the cavity 14, the upper surface 32 slopes inward toward the bottom surface 30 and continues sloping inward into the intermediate portion 14*b*. The strain relief element 34 has a lower surface 34*a* defining part of the upper surface 32 of the rearward portion 14*c* of the cavity 22. In the forward portion 14*c* of cavity 14, apertures 38 are formed in the upper surface 32 in communication with the terminal-receiving slots 16 (FIG. 11).

A plug and its components according to a first embodiment of the invention in which the conductor-receiving passages are arranged in three parallel rows or levels will now be described. In this connection reference is made to FIGS. 1–22 (all these figures without an "a" suffix) which illustrate the first three-level embodiment of the invention.

Figure 12:
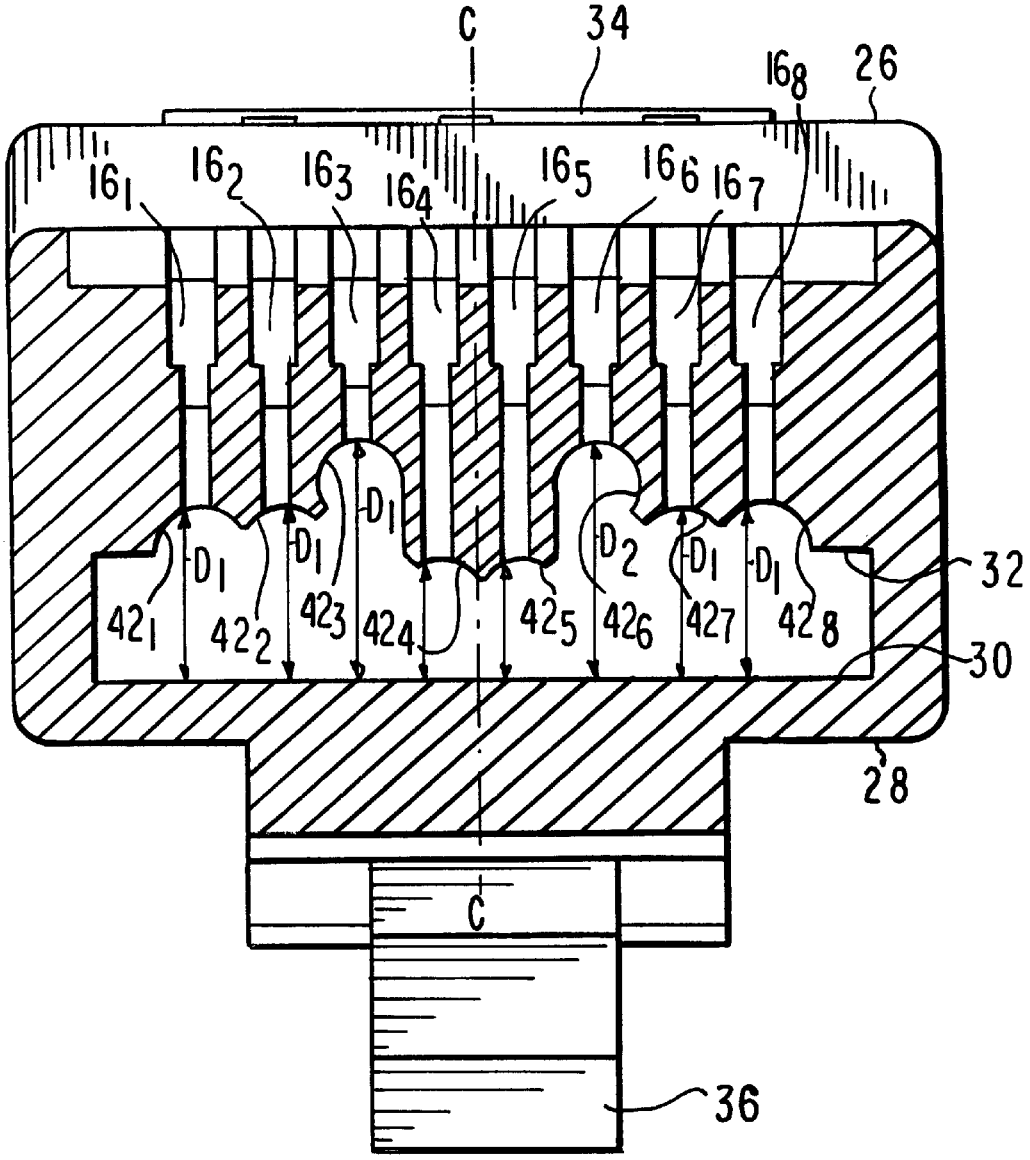
FIG. 12 is a cross-sectional view of the plug housing of the first three-level embodiment of the invention taken along the line 12—12 of FIG. 6.

The plug housing is specially adapted to receive a load bar 18 which positions the conductors in three levels and in accordance with other aspects of the invention. Referring in particular to FIGS. 10 and 12, the upper surface 32 in the forward portion 14*c* of the plug cavity is formed to cooperate with the three levels of conductor-receiving channels 44 in the load bar 18 to retain the conductors of the cable 8 therebetween. To this end, the upper surface 32 includes a plurality of arcuate portions $\mathbf{42}_{1-8}$ the curvature of which is determined by the position of the conductor contacting the arcuate portion $\mathbf{42}_{1-8}$. Since the load bar assembly 18 is designed to retain the conductors of the cable 8 in three different planes (discussed in detail below), the arcuate portions $\mathbf{42}_{1-8}$ of the upper surface 32 are designed similarly at three different spatial separations from the planar bottom face 30 of the cavity 14. In particular, arcuate portions $\mathbf{42}_3$ and $\mathbf{42}_6$ (those situated to overlie the conductors designated 3 and 6 of the cable, not shown) are situated at the largest distance from the bottom face 30 (D1 being the distance between the bottom face 30 and the farthest area of the arcuate portion therefrom), arcuate portions $\mathbf{42}_4$ and $\mathbf{42}_5$ (those situated to overlie the conductors designated 4 and 5 of the cable, not shown) are situated at the shortest distance from the bottom face 30 designated D3, and arcuate portions $\mathbf{42}_1$, $\mathbf{42}_2$, $\mathbf{42}_7$ and $\mathbf{42}_8$ (those situated to overlie the conductors designated 1, 2, 7 and 8 of the cable, not shown) are situated at an intermediate distance from the bottom face 30 designated D2. As a result of the different spacing of the arcuate portions $\mathbf{42}_{1-8}$ from the bottom face 30, the depth of the terminal-receiving slots 16 varies with the deepest slots $\mathbf{16}_4$, $\mathbf{16}_5$ communicating with the arcuate portions $\mathbf{42}_4$ and $\mathbf{42}_5$, the shallowest slots $\mathbf{16}_3$, $\mathbf{16}_6$ communicating with the arcuate portions $\mathbf{42}_3$ and $\mathbf{42}_6$ and the slots $\mathbf{16}_1$, $\mathbf{16}_2$, $\mathbf{16}_7$, $\mathbf{16}_8$ communicating with the arcuate portions $\mathbf{42}_1$, $\mathbf{42}_2$, $\mathbf{42}_7$ and $\mathbf{42}_8$ having an intermediate depth (FIG. 12). In the illustrated embodiment, the upper surface 32 is symmetrical about its center line C. A tapering surface 46 having the same general curvature as each arcuate portion $\mathbf{42}_{1-8}$ is provided rearward thereof to facilitate entry of the conductors of the cable 8 into the forward portion 14*c* (FIG. 11).

By means of such construction of the arcuate portions $\mathbf{42}_{1-8}$ of the upper surface 32 of the forward portion 14*c* of the cavity 14 of the plug housing 12, and the construction of the load bar assembly 18 described below, the conductors of the cable 8 designated 3 and 6 will lie maximally spaced from the conductors designated 4 and 5 and as such, crosstalk between these conductor pairs is minimized.

Figure 13:
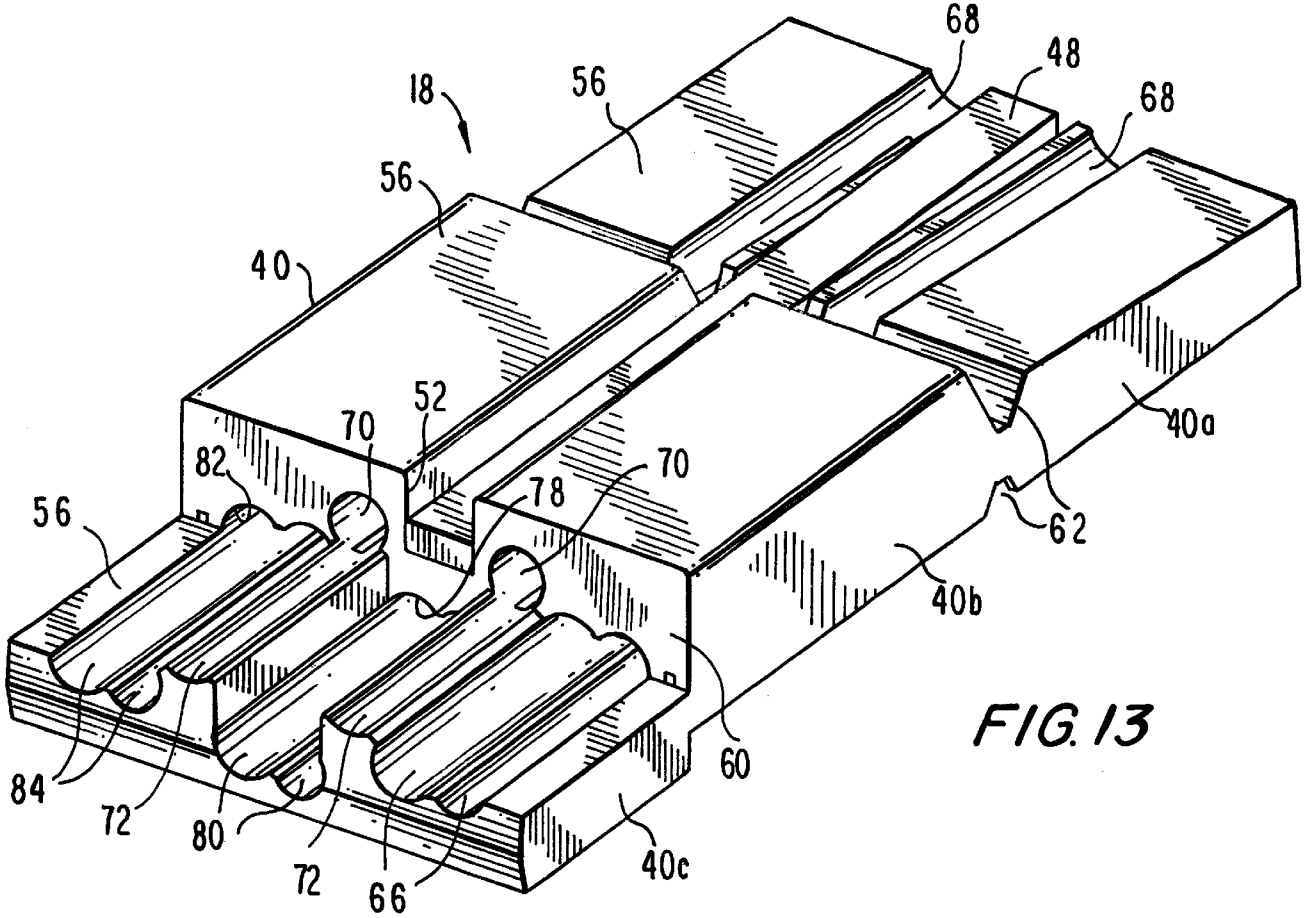
FIG. 13 is a top perspective view of a first three-level embodiment of a load bar assembly forming a part of the first embodiment of the plug shown in FIG. 1.
Figure 14:
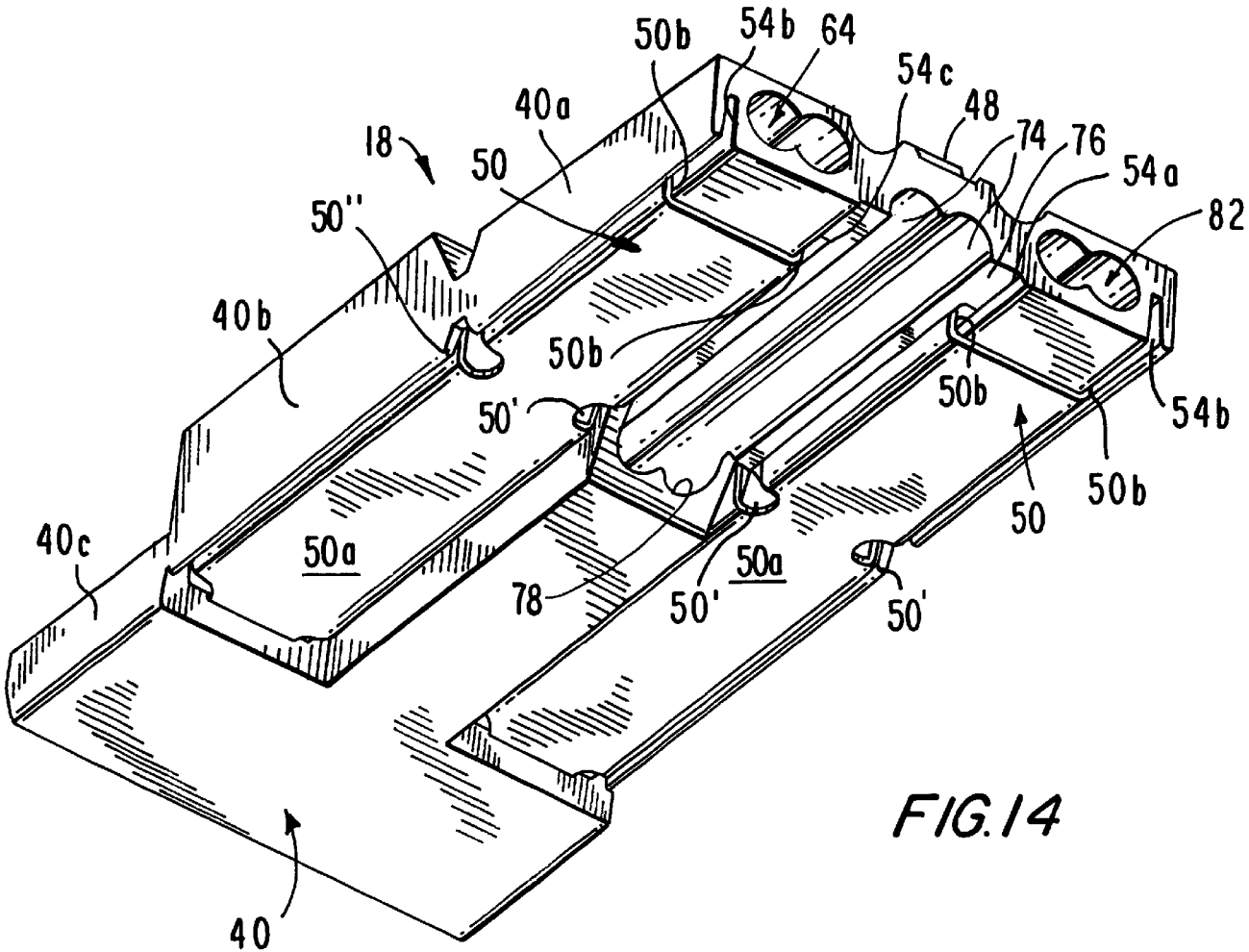
FIG. 14 is a bottom perspective view of the first three-level embodiment of the load bar assembly shown in FIG. 13.

The load bar assembly 18 is shown in detail in FIGS. 13 and 14 and includes a load bar housing 40 and bars or strips of an electrically conductive metallic material 48,50. Conductive strip 48 is elongate and is arranged in a longitudinal channel 52 defined in a center of the load bar housing 40 (FIG. 13). Channel 52 has a width substantially the same as the width of conductive strip 48 and a depth greater than the thickness of conductive strip 48 to avoid projection of the conductive strip 48 above the top surface of the load bar housing 40. The depth of the channel 52 is preferably determined to ensure that the conductive strip 48 will be situated between channels $\mathbf{44}_3$ and $\mathbf{44}_6$ The purpose of the interposition of a metallic element such as conductive strip 48 between these channels, which will receive the conductors designated 3 and 6 forming a conductor pair, is to correct an impedance problem during use of the plug. That is, in view of the separation of conductors 3 and 6 when situated in channels $\mathbf{44}_3$ and $\mathbf{44}_6$, respectively, the return loss is poorer and the presence of conductive strip 48 will compensate for the return loss. Conductive strip 48 may be fixed in channel 52 or movably arranged therein. Referring to FIG. 14, conductive strips 50, of which there are two, are substantially U-shaped and are arranged one on each side of the load bar housing 40. Conductive strips 50 thus have a flat portion 50*a* and projecting portions 50*b* extending from the transverse edges of the flat portion 50*a* and which are substantially parallel to one another. To accommodate conductive strips 50, two pair of parallel, longitudinally-extending grooves 54*a*,54*b* are formed in the lower surface [56] 76 of the load bar housing 40 and receive the projecting portions 50*b* of the conductive strips 50 (FIG. 14). Conductive strips 50 are thus situated adjacent the lower surfaces 58',58" of the load bar housing 40 and partially surround the channels $44_1$,$44_2$,$44_7$,$44_8$ which receive conductors 1, 2, 7 and 8, respectively, of the cable 8 terminated by the plug 10. The conductive strip 50 partly surrounding conductors 1,2 will operatively function to distribute crosstalk between the pair of conductors 1,2 and the other pairs of conductors and the conductive strip 50 partially surrounding conductors 7,8 will operatively function to distribute crosstalk between the pair of conductors 7,8 and the other pairs of conductors. Conductive strips 48,52 may be formed from foil and may be integrated into the load bar housing 40 or the plug housing 12.

Figure 22:
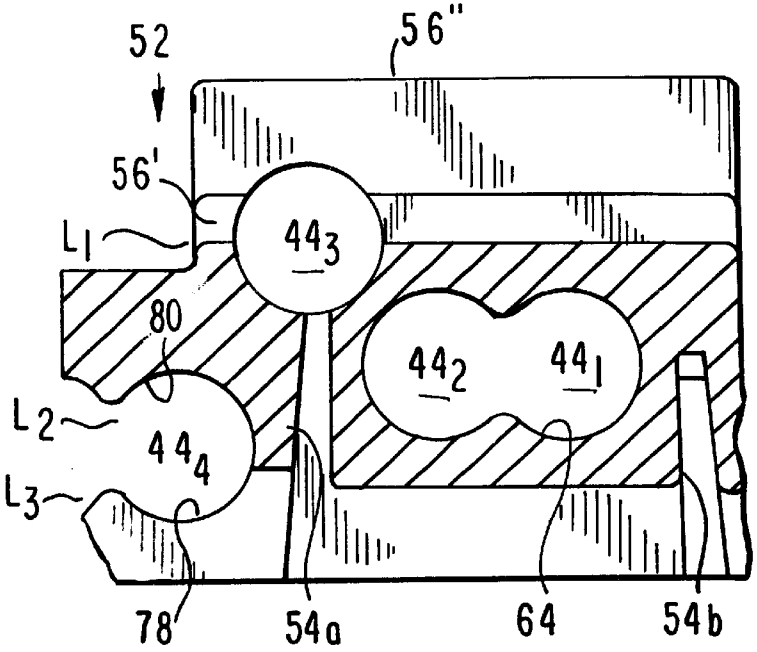
FIG. 22 is a partial cross-sectional view of the first three-level embodiment of the load bar assembly shown in FIG. 13 taken along line 22—22 of FIG. 16.
Figure 18:
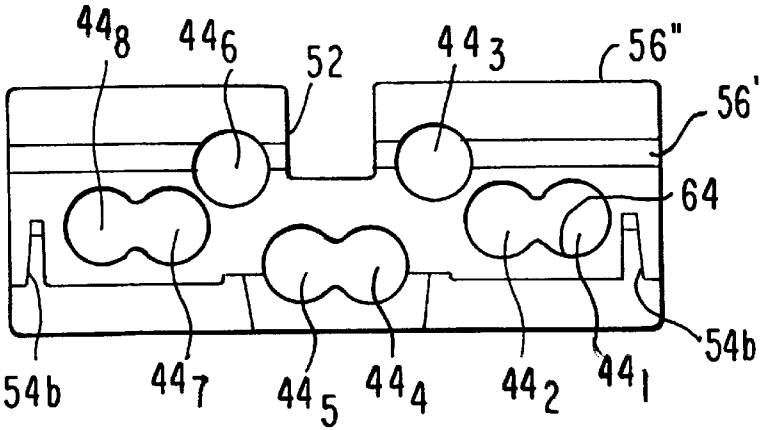

The first embodiment of the load bar housing 40 is shown in FIGS. 15–22 and is made of a dielectric material. Load bar housing 40 is elongate having a length approximately coextensive with cavity 14. Load bar housing 40 has a rearward portion 40*a* adapted to be received in the rearward portion 14*a* of the cavity 14 of the plug housing 12, an intermediate portion 40*b* adapted to be received in the intermediate portion 14*b* of the cavity 14 and a forward portion 40*c* adapted to be received in the forward portion 14*c* of the cavity 14. Channel 52 is formed in the upper surfaces 56',56" of the rearward and intermediate portions 40*a*,40*b* of the load bar housing 40 (FIG. 13). Grooves 54*a*,54*b* are formed in the lower surfaces 58',58" also of the rearward and intermediate portions 40*a*,40*b* of the load bar housing 40 (FIG. 14). Grooves 54*a* communicate with the channels $44_3$ and $44_6$ (FIG. 22). Grooves 54*b* extend to the rear edge of the load bar housing 40 (FIG. 14). A step 60 (FIG. 13) is formed between the forward and intermediate portions 40*c*,40*b* which, upon insertion of load bar assembly 18 in the cavity 14, will abut against a shoulder 60*a* defined between intermediate and forward cavity portion 14*b* and 14*c* (FIG. 11).

Load bar housing 40 further includes a "hinge" to enable rotational movement of the rearward portion 40*a* relative to the intermediate and forward portions 40*b*,40*c*. This movement may be realized once the load bar assembly 18 is inserted into the cavity 14 and the forward portion 40*c* of the load bar 40 is fixed within the forward portion 14*c* of the cavity 14. To this end, the load bar housing 40 includes aligned transverse slits 62 on both the upper and lower sides. The presence of slits 62 allows the rearward portion 40*a* of the load bar housing 40 to flex with respect to the intermediate and forward portions 40*b*,40*c*. Also, the conductive strips 50 are provided with notches 50' on each side in alignment with the slits 62 to reduce their rigidity and facilitate the flexure of the load bar housing 40 (FIG. 14).

Figure 15:
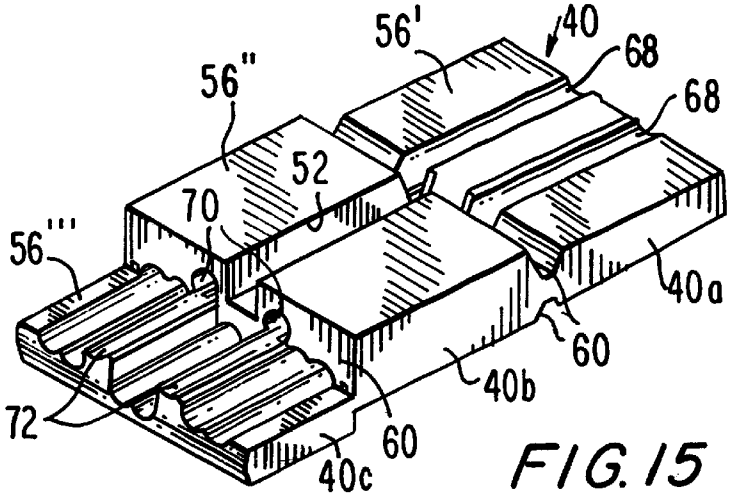
FIG. 15 is a top perspective view of a first three-level embodiment of a load bar assembly forming a part of the first embodiment of the plug shown in FIG. 1.
Figure 21:
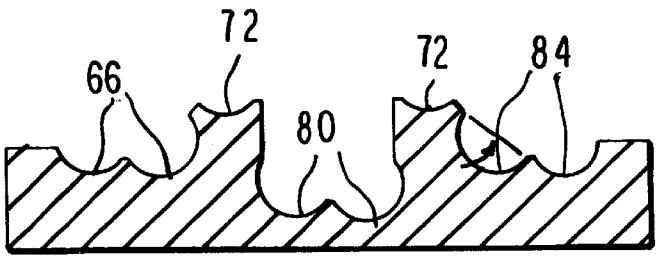
FIG. 21 is a cross-sectional view of the first three-level embodiment of the load bar assembly shown in FIG. 13 taken along the line 21—21 of FIG. 16.
Figure 19:
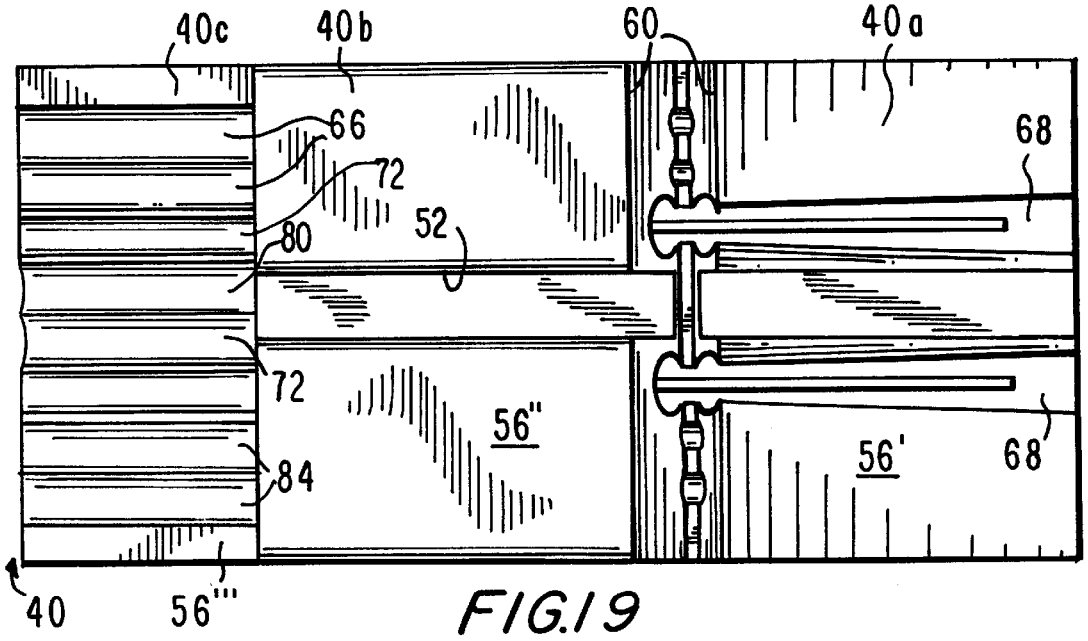
FIG. 19 is a top view of the first three-level embodiment of the load bar assembly shown in FIG. 13.
Figure 20:
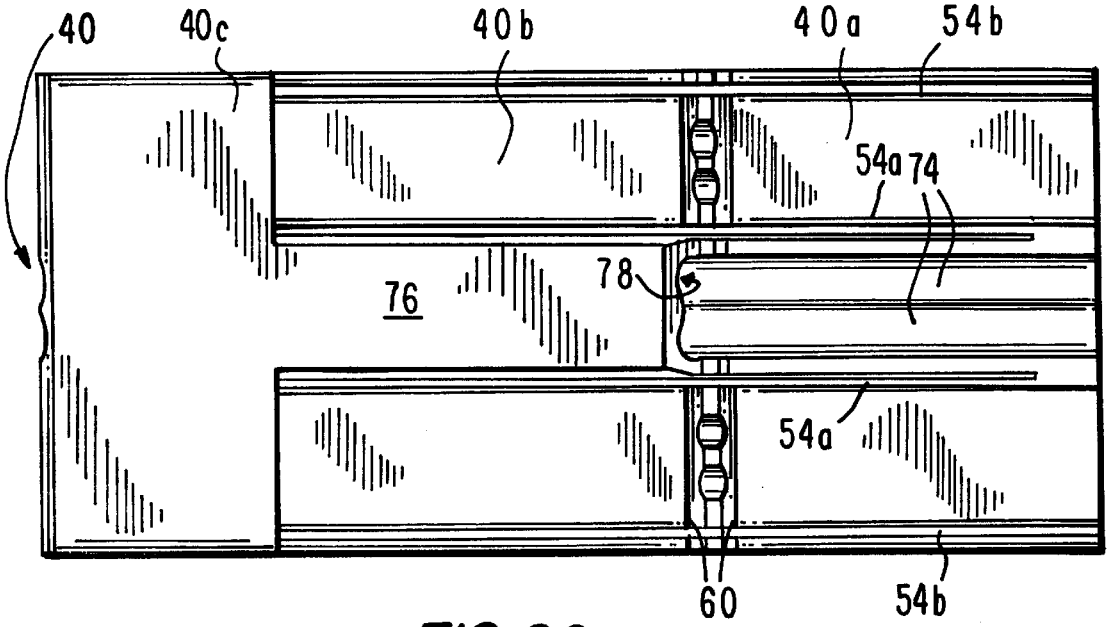
FIG. 20 is a bottom view of the first three-level embodiment of the load bar assembly shown in FIG. 13.
Figure 19A:
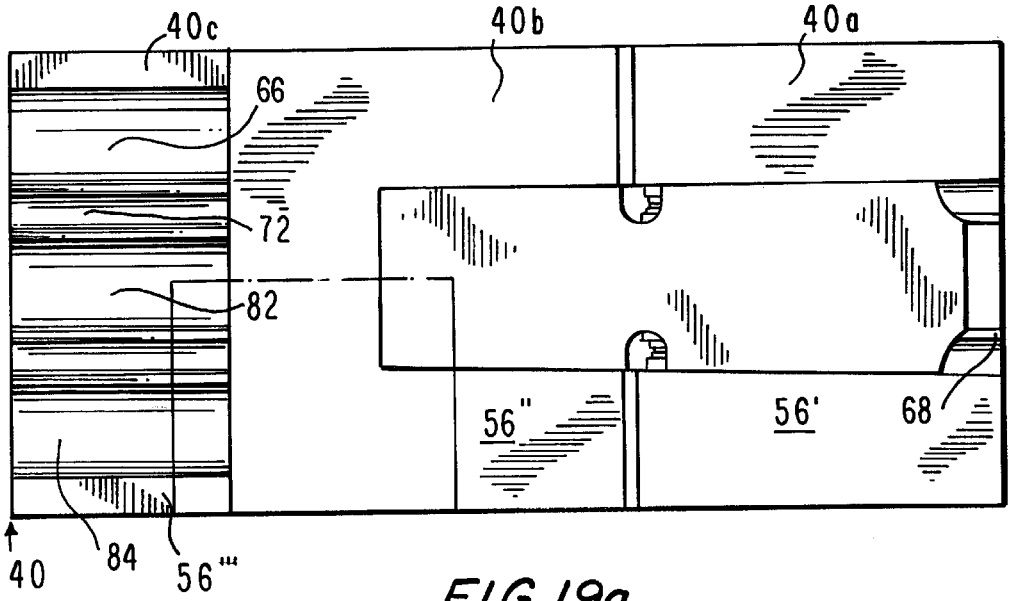
Figure 20A:
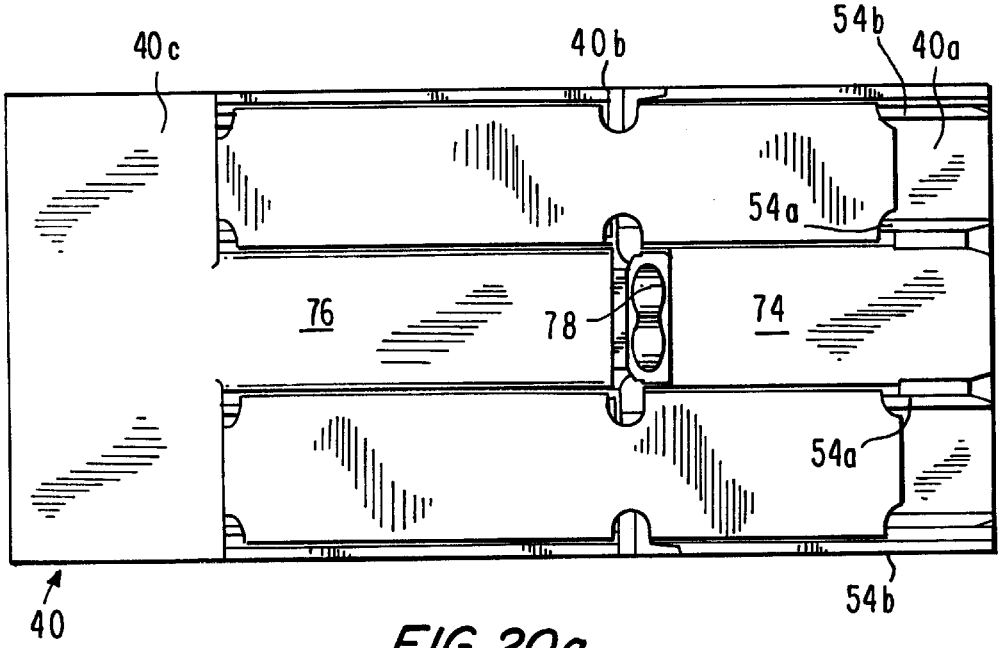

The channels $44_1$, . . . , $44_8$ in the load bar housing 40 are constructed in a particular manner to position the conductors of the cable terminated by the plug 10 in three different planes. Channels $44_1$, . . . , $44_8$ extend from one edge of the load bar housing 40 to the other edge. The channels $44_1$, . . . , $44_8$ are numbered in sequence from left to right and the number corresponds to the designated number of the conductor of the cable 8 received in that channel. Channels $44_1$ and $44_2$ are situated alongside one another and formed by a shaped body or cavity 64 (FIGS. 14 and 22) in the load bar housing 40 extending through the rearward portion 40*a* and intermediate portion 40*b*. In the forward portion 40*c*, the channels $44_1$ and $44_2$ are each defined by an arcuate indentation or trough 66 of the upper surface 56''' of the load bar housing 40 (FIG. 21). Channels $44_3$ and $44_6$ are each formed by a longitudinal indentation or trough 68 in the upper surface 56' of the rearward portion 40*a* of the load bar housing 40, a shaped cavity or bore 70 in the load bar housing 40 extending through the intermediate portion 40*b* and an indentation or trough 72 of the upper surface 56''' of the forward portion 40*c* (FIG. 15). Channels $44_4$ and $44_5$ are situated alongside one another and formed by indentations or troughs 74 in the lower surface 76 of the rearward portion 40*a* (FIG. 14), a cavity or bore 78 in the load bar housing 40 extending through the intermediate portion 40*a* and indentations 80 of the upper surface 56''' of the forward portion 40*c*. Channels $44_7$ and $44_8$ are situated alongside one another and formed by a closed cavity or bore 82 in the load bar housing 40 extending through the rearward portion 40*a* and intermediate portion 40*b*. In the forward portion 40*c*, the channels $44_7$ and $44_8$ are each defined by an open arcuate indentation 84 of the upper surface 56''' of the load bar housing 40 (FIG. 21). Instead of forming channels $44_4$ and $44_5$ on the lower surface 76 of the load bar housing 40, it is also possible to form these channels within the load bar housing 40.

Figure 17:
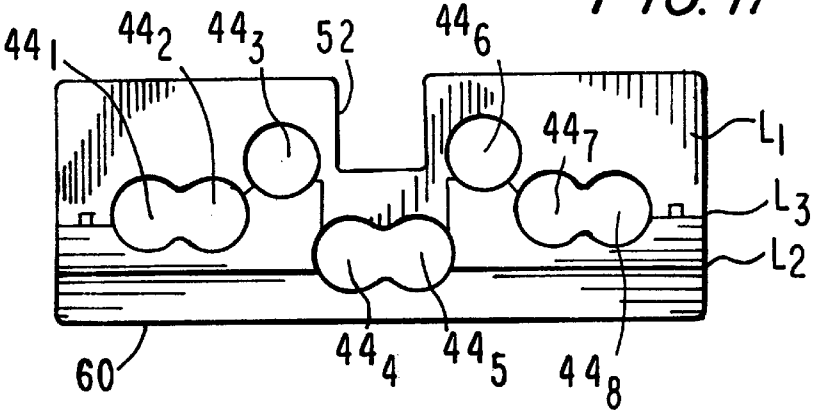
FIG. 17 is a front view of the first three-level embodiment of the load bar assembly shown in FIG. 13.

Thus, channels $44_1$, . . . , $44_8$ are arranged in three different, substantially parallel levels. Channels $44_3$ and $44_6$ are arranged at a first level L1 (the "level" being represented by a plane passing through the central axes of the channels $44_1$, . . . , $44_8$) which will be nearest the top face 26 of the plug housing 12, channels $44_1$, $44_2$, $44_7$ and $44_8$ are arranged at second level L2 below the first level L1 and channels $44_4$ and $44_5$ are arranged at a third level L3 below the second level L2 and which will be nearest the bottom face 28 of the plug housing 12 (FIGS. 17 and 22).

As noted above, channels $44_1$, . . . , $44_8$ are arranged relative to one another to accommodate the eight conductors of an eight-conductor cable 8 in a specific sequence. That is, the cable 8 includes conductors or conductors designated 1–8 and the conductors are inserted into the channels $44_1$, . . . , $44_8$ in the load bar housing 40, respectively. The channels $44_1$, $44_2$, $44_7$ and $44_8$ which are arranged at the longitudinally extending transverse edges of the load bar housing 40 thus receive the conductors designated 1, 2, 7 and 8, respectively. The passages $44_3$ and $44_6$ which are arranged immediately inward of passages $44_2$ and $44_7$ respectively, thus receive the conductors designated 3 and 6, respectively, and the passages $44_4$ and $44_5$ in the middle receive the conductors designated 4 and 5, respectively. As is known in the art, according to a standard terminating convention, conductors 4 and 5 operatively form conductor pair #1, conductors 1 and 2 form conductor pair #2, conductors 3 and 6 form conductor pair #3 and conductors 7 and 8 form conductor pair #4.

Figure 4A:
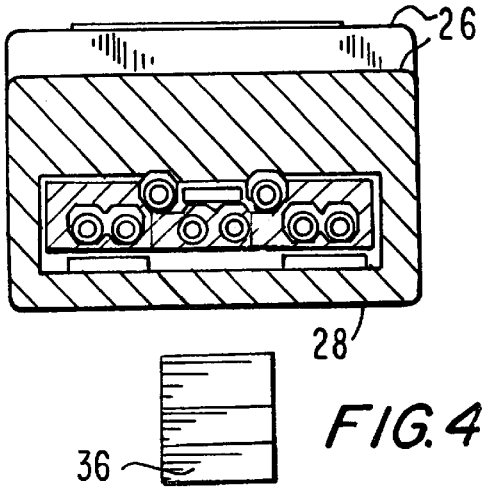
FIGS. 3*a*, 4*a* and 5*a* are views of a second two-level embodiment of a plug in accordance with the invention corresponding to the views of the first embodiment shown in FIGS. 3, 4 and 5.
Figure 5A:
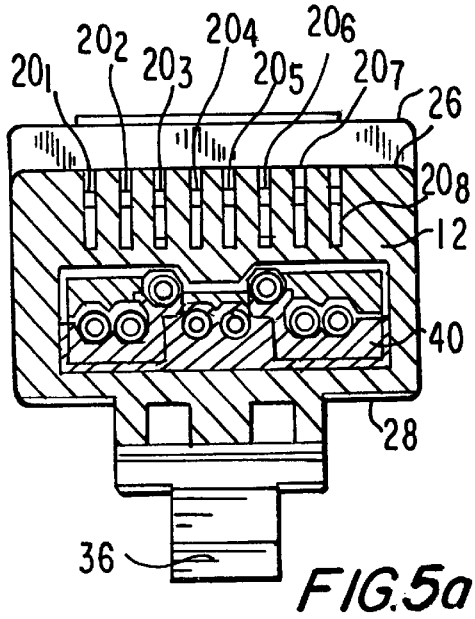
Figure 3A:
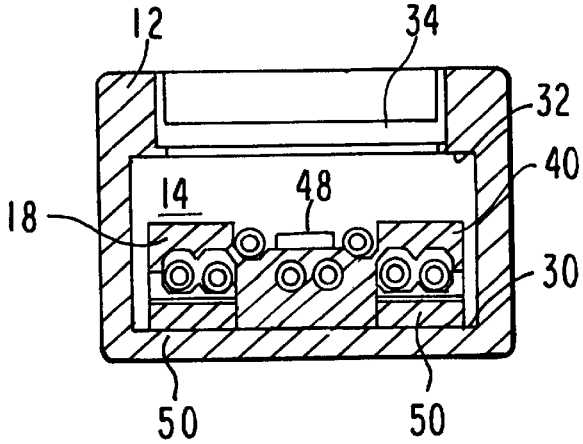
Figure 6:
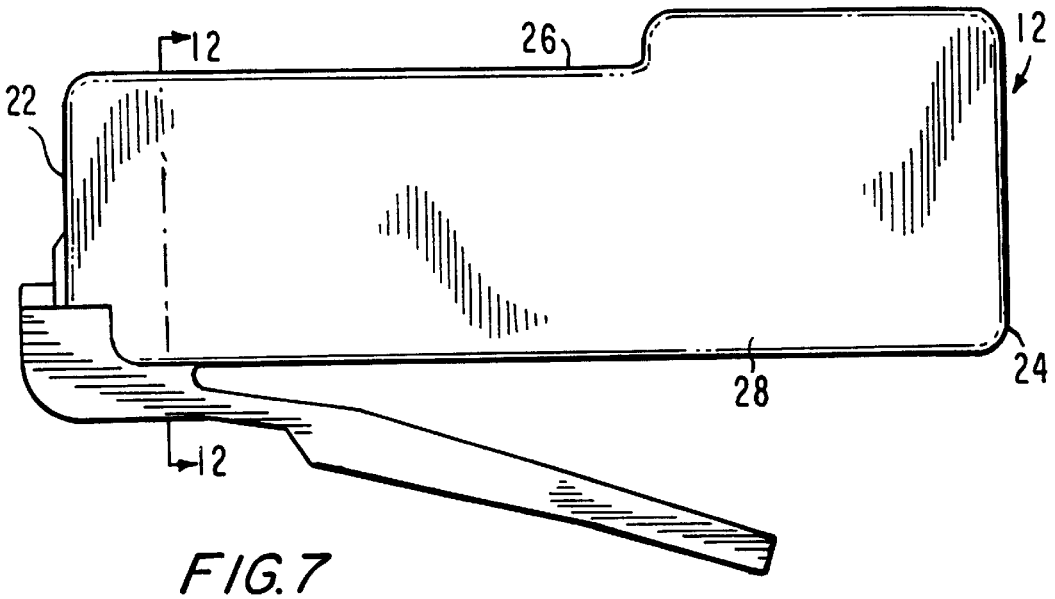
FIG. 6 is a side view of a plug housing of the first three level embodiment of the plug shown in FIG. 1, a side view of a plug of the second two-level embodiment being substantially the same.
Figure 7:
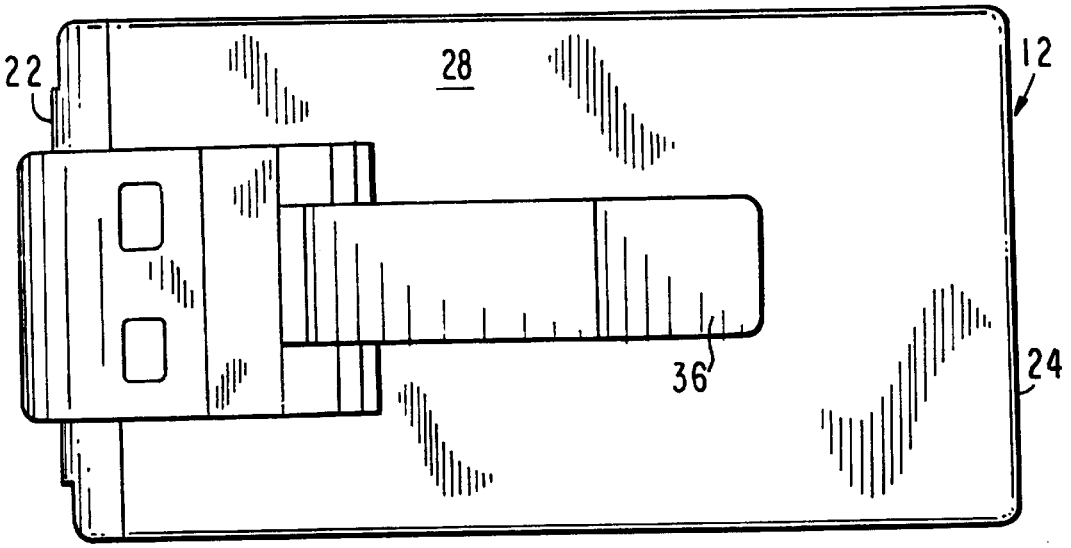
FIG. 7 is a bottom view of the plug housing shown in FIG. 6, a bottom view of a plug of the second embodiment being substantially the same.

The arrangement of the channels $44_3$,$44_4$,$44_5$,$44_6$ in the two maximally spaced-apart levels L1,L3 is designed to reduce the crosstalk between the conductor pairs 1 and 3 during use of the plug 10. Specifically, it has been found that as the distance increases between the plane of conductors 4 and 5 of conductor pair #1 in the plug 10 and the plane containing conductors 3 and 6 of conductor pair #3, i.e., the distance between level L1 and level L3, crosstalk is reduced. Thus, since it is most desirable to reduce crosstalk between the conductor pairs #1 and #3, the level L1 of passages $44_3$,$44_6$ is maximally spaced from the level L3 of passages $44_4$,$44_5$. In other words, as shown in FIGS. 3 and 4, the distance between the level L2 and each of levels L1 and L3 is less than the distance between the levels L1 and L3. It must be recognized that other combinations of two conductor pairs can be spaced apart from one another to provide a maximum separation by arranging the corresponding passages at the maximum separation from one another.

Figure 1A:
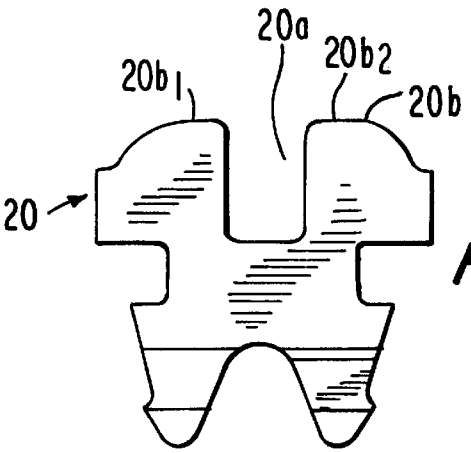
FIG. 1A is an enlarged view of a terminal blade of the modular plug shown in FIG. 1.

In view of the arrangement of the conductor-receiving passages 44 in three levels in the plug housing 12, the plug 10 includes three sizes of terminal blades 20 received in the terminal-receiving slots 16 (FIGS. 1 and 5). Terminal blades $\mathbf{20}_3$,$\mathbf{20}_6$ are the shortest and each is arranged in a respective one of the slots 16 communicating with passages $\mathbf{44}_3$,$\mathbf{44}_6$, terminal blades $\mathbf{20}_4$,$\mathbf{20}_5$ are the longest and each is arranged in a respective one of the slots 16 communicating with passages $\mathbf{44}_4$,$\mathbf{44}_5$, and terminal blades $\mathbf{20}_1$,$\mathbf{20}_2$,$\mathbf{20}_7$ and $\mathbf{20}_8$ have an intermediate length and each is arranged in a respective one of the slots 16 communicating with passages $\mathbf{44}_1$,$\mathbf{44}_2$,$\mathbf{44}_7$,$\mathbf{44}_8$.

A plug and its components according to a second embodiment of the invention in which the conductor-receiving passages are arranged in two parallel rows or levels will now be described. In this connection reference is specially made to FIGS. 3*a*–5*a*, 10*a* and 12*a*–22*a*, (i.e., all figures designated with an "a" suffix) which specifically illustrate views of the second embodiment of the invention.

Figure 10A:
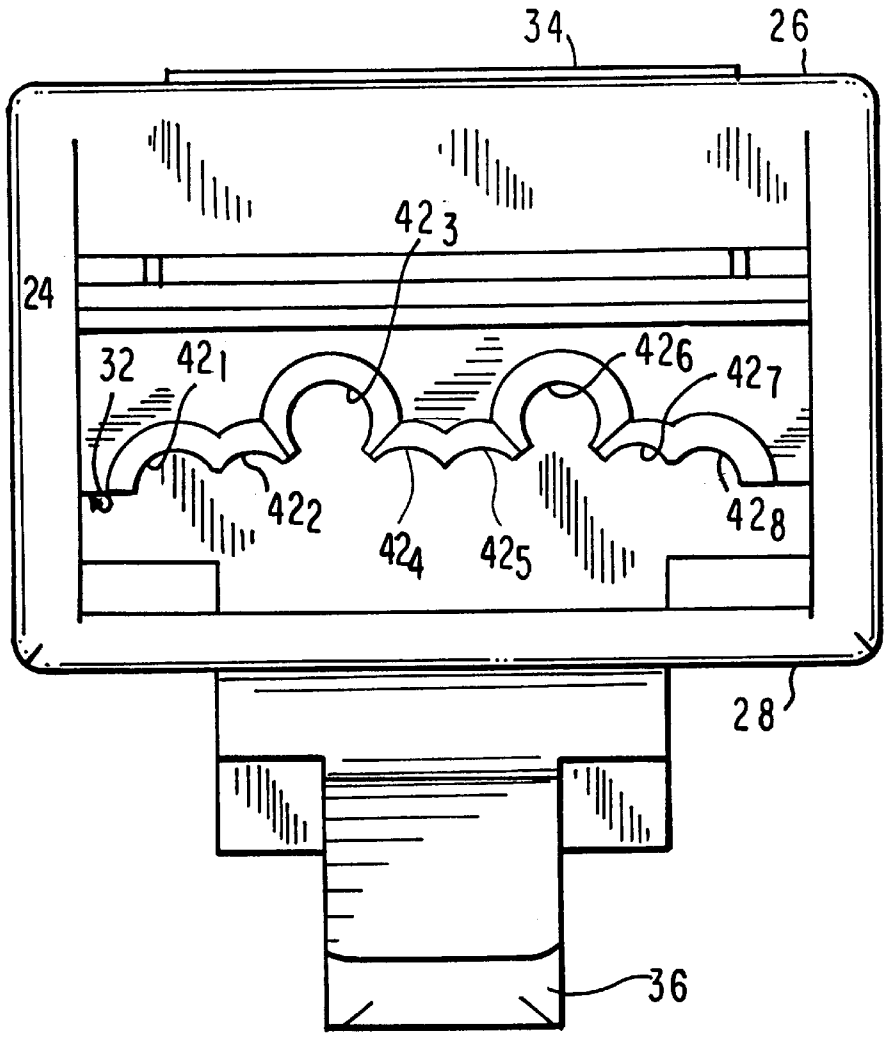
FIG. 10*a* is a rear view of the plug housing of the second two-level embodiment of the invention.
Figure 12A:
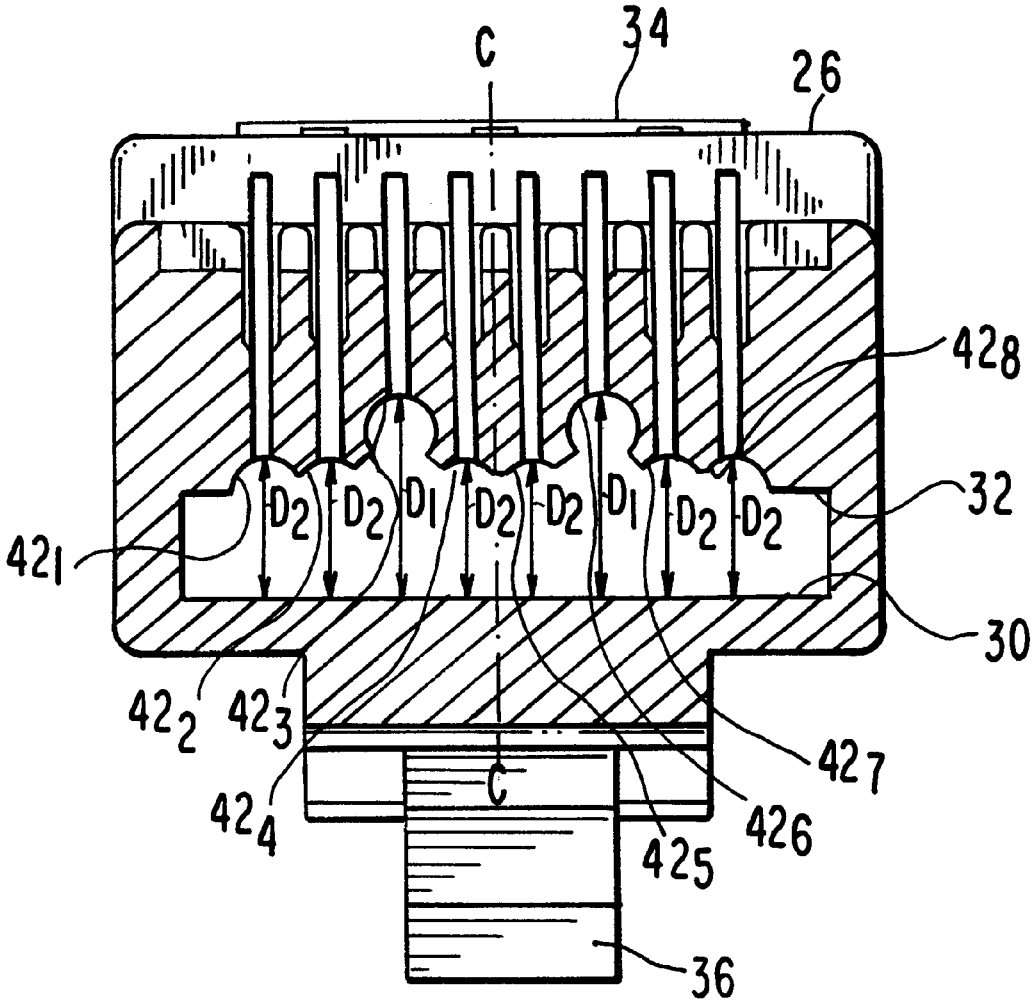

Initially, the plug housing is specially adapted to receive a load bar 18 which positions the conductors in two levels and in accordance with other aspects of the invention. Referring in particular to FIGS. 10*a* and 12*a*, the upper surface 32 in the forward portion 14*c* of the plug cavity is formed to cooperate with the two levels of conductor-receiving channels $\mathbf{44}_1, \ldots, \mathbf{44}_8$ in the load bar 18 to retain the conductors of the cable 8 therebetween. To this end, the upper surface 32 includes a plurality of arcuate portions $\mathbf{42}_{1-8}$ the curvature of which is determined by the position of the conductor contacting the arcuate portion $\mathbf{42}_{1-8}$. Since the load bar assembly 18 is designed to retain the conductors of the cable 8 in two different planes (discussed in detail below), the arcuate portions $\mathbf{42}_{1-8}$ of the upper surface 32 are designed similarly at two different spatial separations from the planar bottom face 30 of the cavity 14. In particular, arcuate portions $\mathbf{42}_3$ and $\mathbf{42}_6$ (those situated to overlie the conductors designated 3 and 6 of the cable) are situated at the largest distance from the bottom face 30 (D1 being the distance between the bottom face 32 and the farthest area of the arcuate portion therefrom), and arcuate portions $\mathbf{42}_1$, $\mathbf{42}_2$, $\mathbf{42}_4$, $\mathbf{42}_5$, $\mathbf{42}_7$ and $\mathbf{42}_8$ (those situated to overlie the conductors designated 1, 2, 4, 5, 7 and 8 of the cable) are situated at the shortest distance from the bottom face 30 designated D2. As a result of the different spacing of the arcuate portions $\mathbf{42}_{1-8}$ from the bottom face 30, the depth of the terminal-receiving slots 16 varies with the deepest slots $\mathbf{16}_1$, $\mathbf{16}_2$, $\mathbf{16}_4$, $\mathbf{16}_5$, $\mathbf{16}_7$, and $\mathbf{16}_8$ communicating with the arcuate portions $\mathbf{42}_1$, $\mathbf{42}_2$, $\mathbf{42}_4$, $\mathbf{42}_5$, $\mathbf{42}_7$ and $\mathbf{42}_8$ and the shallowest slots $\mathbf{16}_3$, $\mathbf{16}_6$ communicating with the arcuate portions $\mathbf{42}_3$ and $\mathbf{42}_6$ (FIG. 12*a*). In the illustrated embodiment, the upper surface 32 is symmetrical about its center line C.

By means of such construction of the arcuate portions $\mathbf{42}_{1-8}$ of the upper surface 32 of the forward portion 14*c* of the cavity 14 of the plug housing 12, and the construction of the load bar assembly 18 described below, the conductors of the cable 8 designated 3 and 6 will lie maximally spaced from the conductors designated 4 and 5 and as such, crosstalk between these conductor pairs is minimized.

Figure 13A:
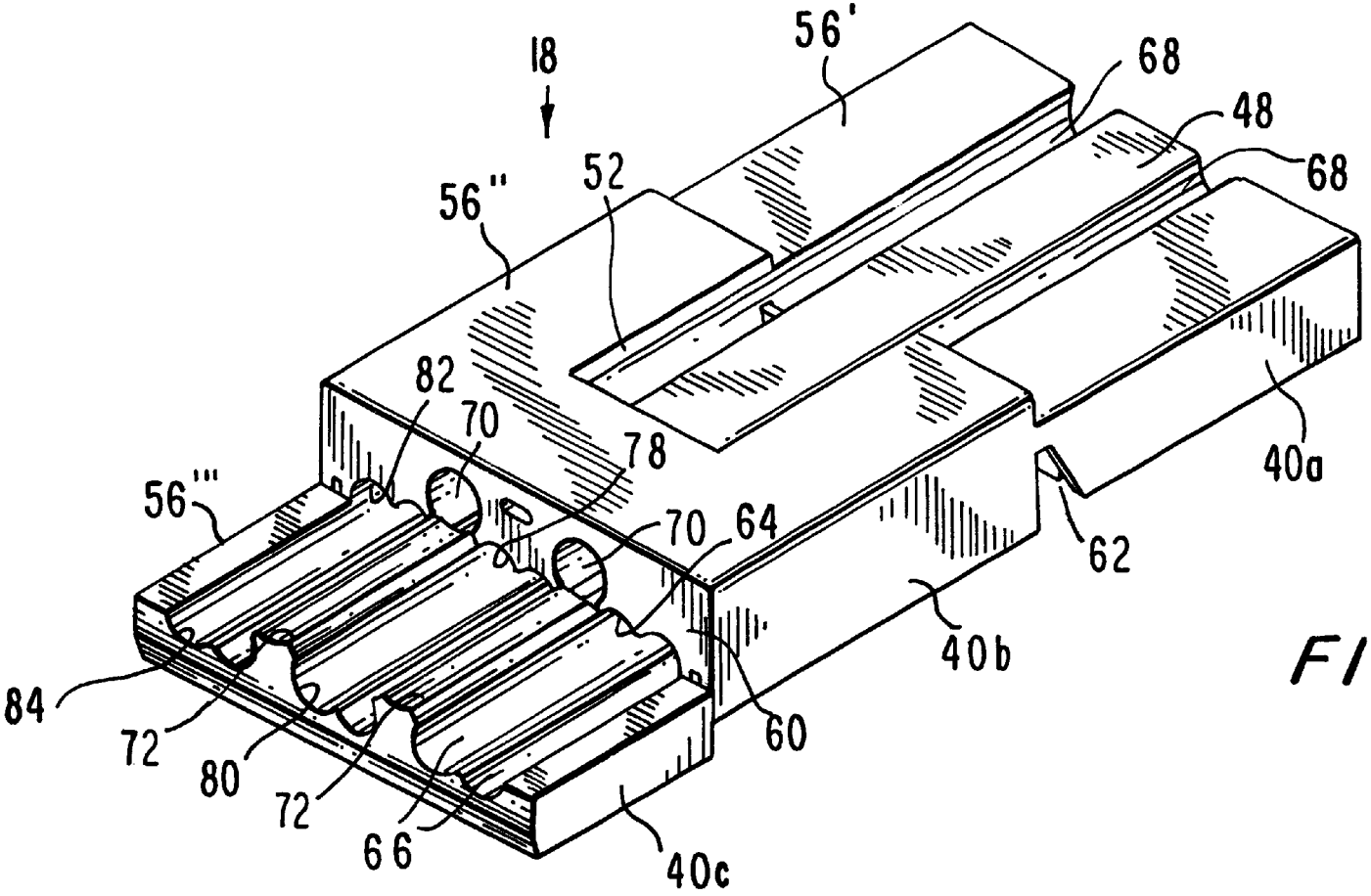
Figure 14A:
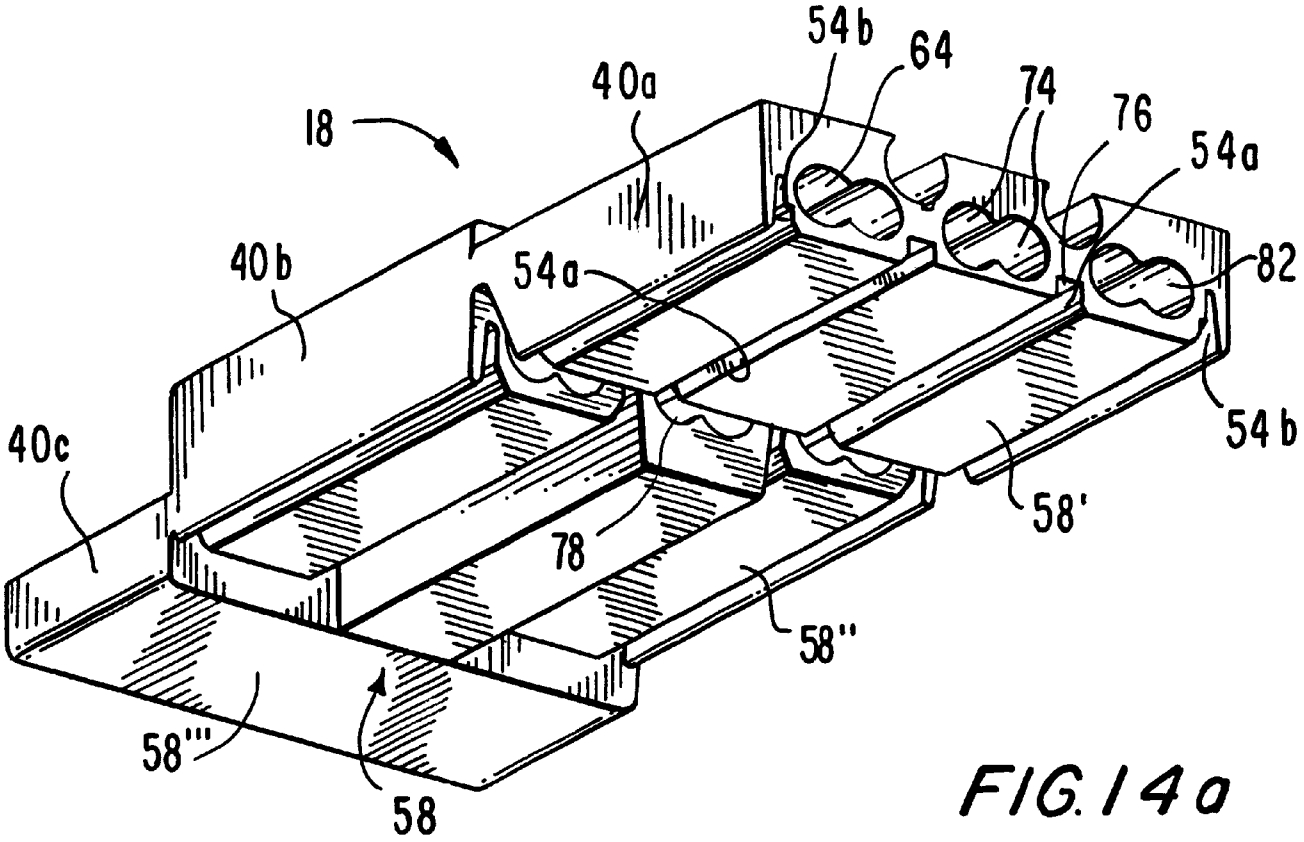
Figure 16:
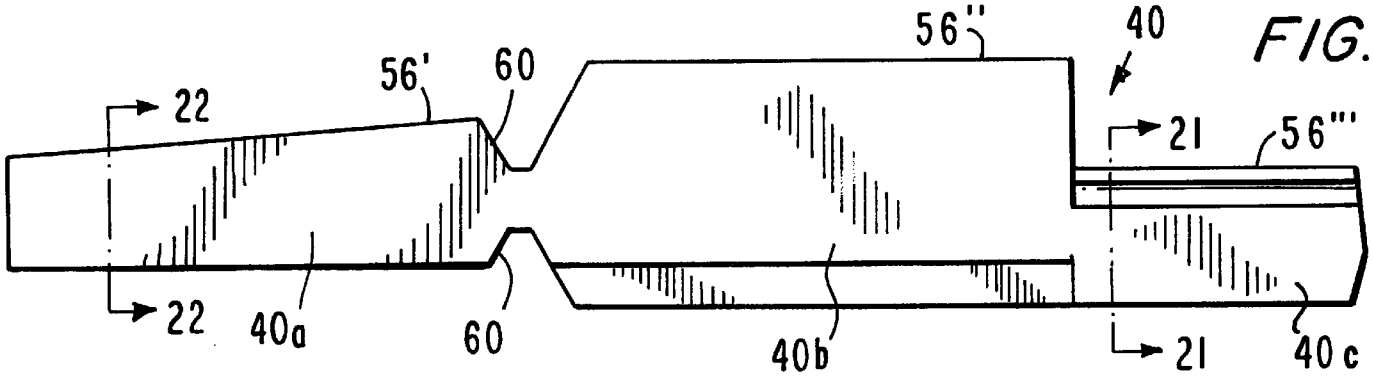
FIG. 16 is a left side view of the first three-level embodiment of the load bar assembly shown in FIG. 13.
Figure 15A:
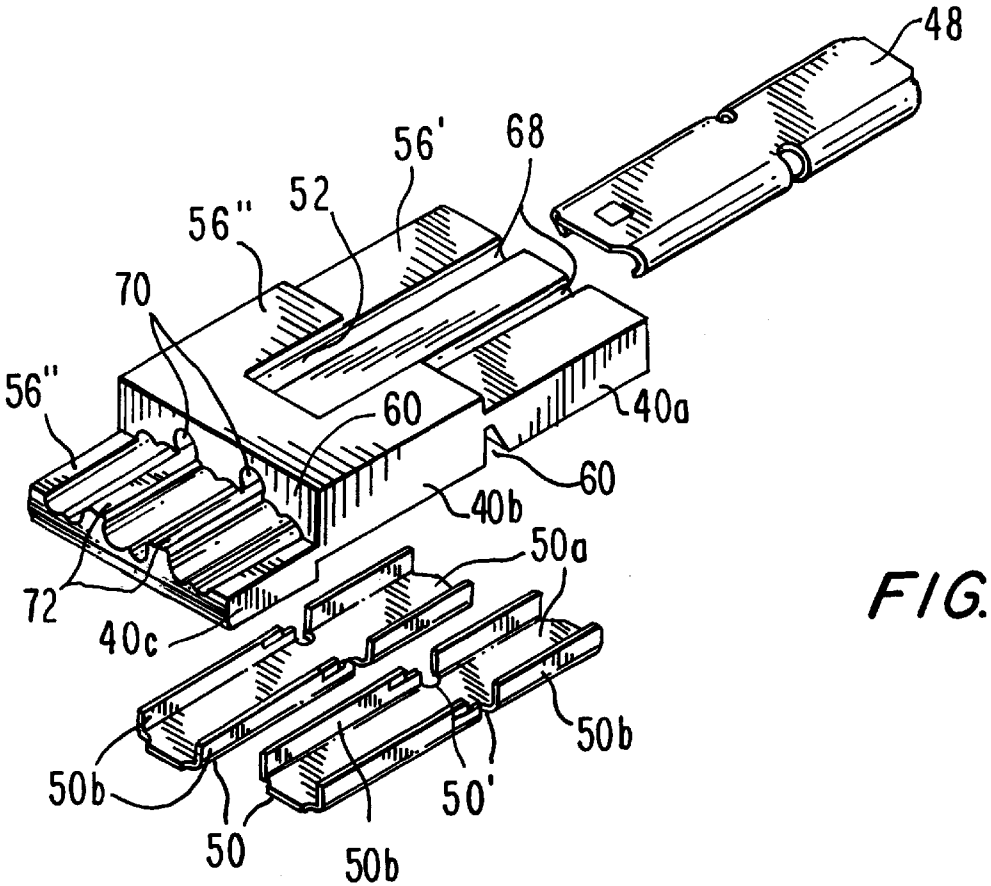
FIG. 15*a* is an exploded perspective view of the second two-level embodiment of the load bar assembly shown in FIG. 13*a;*

The second embodiment of the load bar assembly 18 is shown in detail in FIGS. 13*a* and 14*a* and includes a load bar housing 40, a conductive strip 48 cover 48*a* made of an electrically conductive metallic material and a pair of conductive strips 50. Conductive strip cover 48*a* is elongated and is arranged in a longitudinal channel 52 defined in a center of the load bar housing 40 (FIG. 13*a*). Channel 52 has a width substantially the same as the width of conductive strip cover 48*a* and a depth greater than the thickness of conductive strip cover 48 in order to avoid projection of the conductive strip cover 48 above the top surface of the load bar housing 40. The depth of the channel 52 is preferably determined to ensure that the conductive strip cover 48*a* will be situated between channels $\mathbf{44}_3$ and $\mathbf{44}_6$. The purpose of the interposition of a metallic element such as conductive strip cover 48*a* between these channels, which will receive the conductors designated 3 and 6 forming a conductor pair is the same as in the first embodiment. Conductive strip cover 48*a* may be fixed in channel 52 or movably arranged therein. Referring to FIG. 15*a*, conductive strips 50, of which there are two, are substantially U-shaped and are arranged one on each side of the load bar housing 40. Conductive strips 50 thus have a flat portion 50*a* and projecting portions 50*b* extending from the transverse edges of the flat portion 50*a* and which are substantially parallel to one another. To accommodate conductive strips 50, two pair of parallel, longitudinally-extending grooves 54*a*,54*b* are formed in the lower surface 76 of the load bar housing 40 and receive the projecting portions 50*b* of the conductive strips 50 (FIG. 15*a*). Conductive strips 50 are thus situated adjacent the lower surfaces 58',58" of the load bar housing 40 and partially surround respective ones of the two pairs of channels $\mathbf{44}_1$,$\mathbf{44}_2$,$\mathbf{44}_7$, and $\mathbf{44}_8$ which receive conductors 1, 2, 7 and 8, respectively, of the cable 8 terminated by the plug 10. The conductive strip 50 partly surrounding conductors 1,2 will operatively function to distribute crosstalk between the pair of conductors 1,2 and the other pairs of conductors and the conductive strip 50 partially surrounding conductors 7,8 will operatively function to distribute crosstalk between the pair of conductors 7,8 and the other pairs of conductors. Conductive strips 48,52 may be formed from foil and may be integrated into the load bar housing 40 or the plug housing 12.

Figure 22A:
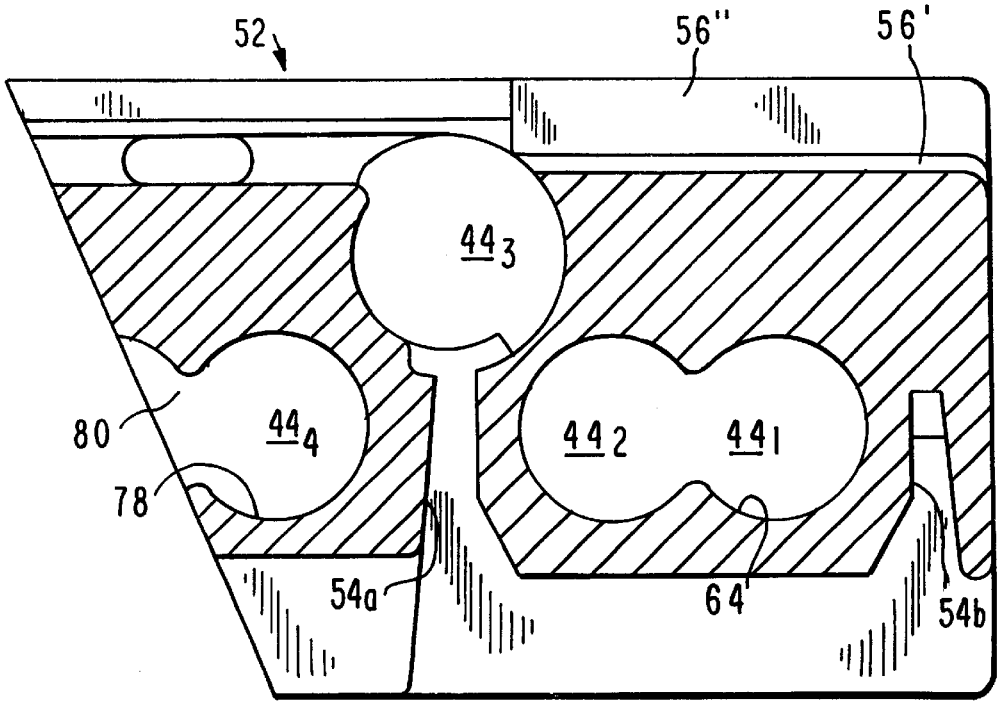

The second embodiment of the load bar housing 40 is shown in FIGS. 15*a*–22*a* and is made of a dielectric material. Load bar housing 40 is elongate having a length approximately coextensive with cavity 14. Load bar housing 40 has a rearward portion 40*a* adapted to be received in the rearward portion 14*a* of the cavity 14 of the plug housing 12, an intermediate portion 40*b* adapted to be received in the intermediate portion 14*b* of the cavity 14 and a forward portion 40*c* adapted to be received in the forward portion 14*c* of the cavity 14. Channel 52 is formed in the upper surface 56' of the rearward body portion 40*a* and extends partially through the upper surface 56" of the intermediate body portion 40*b*. Grooves 54*a*,54*b* are formed in the lower surfaces 58',58" also of the rearward and intermediate portions 40*a*,40*b* of the load bar housing 40 (FIG. 14*a*). Grooves 54*a* communicate with the channels $\mathbf{44}_3$ and $\mathbf{44}_6$ (FIG. 22*a*). Grooves 54*b* extend to the rear edge of the load bar housing 40 (FIG. 14*a*). A step 60 (FIG. 13*a*) is formed between the forward and intermediate portions 40*c*, 40*b* which, upon insertion of load bar assembly 18 in the cavity 14, will abut against a shoulder 60*a* defined between intermediate and forward cavity portion 14*b* and 14*c* (FIG. 11).

Load bar housing 40 further includes a "hinge" to enable rotational movement of the rearward portion 40*a* relative to the intermediate and forward portions 40*b*,40*c*. This movement may be realized once the load bar assembly 18 is inserted into the cavity 14 and the forward portion 40*c* of the load bar 40 is fixed within the forward portion 14*c* of the cavity 14. To this end, the load bar housing 40 includes a transverse slit 62 on the lower side. The presence of slit 62 allows the rearward portion 40*a* of the load bar housing 40 to flex with respect to the intermediate and forward portions 40*b*,40*c*. Also, the conductive strips 50 are provided with notches 50' on each side in alignment with the slits 62 to reduce their rigidity and facilitate the flexure of the load bar housing 40 (FIG. 15*a*).

Figure 21A:
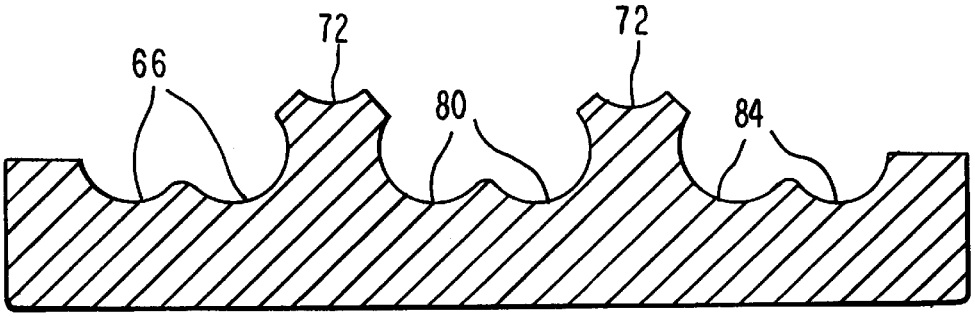

The channels $44_1, \ldots, 44_8$ in the load bar housing 40 are constructed in a particular manner to position the conductors of the cable terminated by the plug 10 in two different planes. Channels $44_1, \ldots, 44_8$ extend from one edge of the load bar housing 40 to the other edge. The channels $44_1, \ldots, 44_8$ are numbered in sequence from left to right and the number corresponds to the designated number of the conductor of the cable 8 received in that channel. Channels $44_1$ and $44_2$ are situated alongside one another and formed by a shaped bore or cavity 64 (FIGS. 14*a* and 22*a*) in the load bar housing extending through the rearward portion 40*a* and intermediate portion 40*b*. In the forward portion 40*c*, the channels $44_1$ and $44_2$ are each defined by an arcuate indentation or trough 66 of the upper surface 56''' of the load bar housing 40 (FIG. 21*a*). Channels $44_3$ and $44_6$ are each formed by a longitudinal indentation or trough 68 in the upper surface 56' of the rearward portion 40*a* of the load bar housing 40 and which extends partially over the upper surface 56'' of the intermediate portion 40*b* of load bar housing 40, a shaped cavity or bore 70 in the load bar housing 40 extending through the remainder of the intermediate portion 40*b*, and an indentation or trough 72 in the upper surface 56''' of the forward portion 40*c*(FIG. 13*a*). Channels $44_4$ and $44_5$ are situated alongside each other and are formed by a shaped cavity or bore 78 in the load bar housing extending through the rearward and intermediate load bar body portions 40*a*, 40*b* and indentations 80 of the upper surface 56''' of the forward portion 40*c*. Channels $44_7$ and $44_8$ are situated alongside one another and are formed by a shaped cavity or bore 82 in the load bar housing extending through the rearward and intermediate load bar body portions 40*a*, 40*b* and indentations 84 of the upper surface 56''' of the forward portion 40*c*.

Figure 17A:
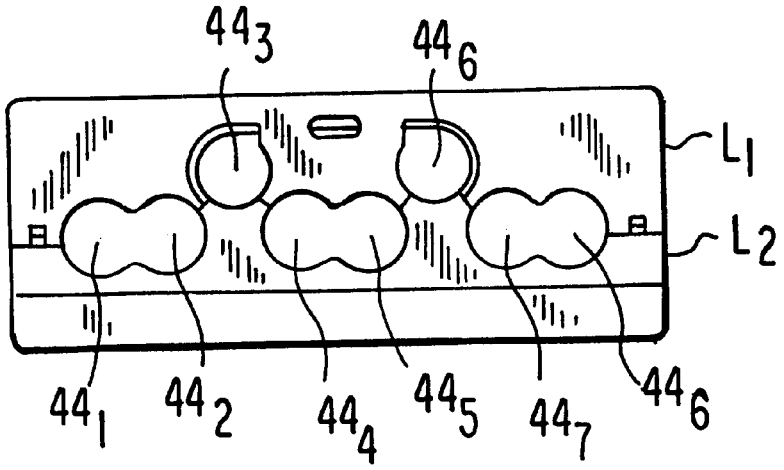
Figure 18A:
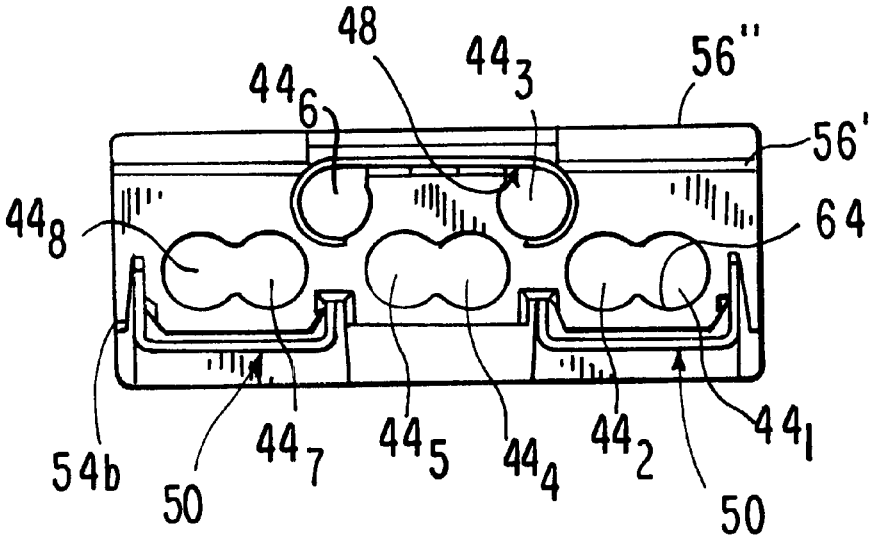
FIG. 18 is a rear view of the first three-level embodiment of the load bar assembly shown in FIG. 13.

Thus, channels $44_1, \ldots, 44_8$ are arranged in three different, substantially parallel levels. Channels $44_3$ and $44_6$ are arranged at a first level L1 (the "level" being represented by a plane passing through the central axes of the channels 44) which will be nearest the top face 56 of the plug housing 12, channels $44_1$, $44_2$, $44_4$, $44_5$, $44_7$ and $44_8$ are arranged at second level L2 below the first level L1 nearest the bottom face 58 of the plug housing 12 (FIGS. 17*a* and 22*a*).

As noted above, channels $44_1, \ldots, 44_8$ are arranged relative to one another to accommodate the eight conductors of an eight-conductor cable 8 in a specific sequence. That is, the cable 8 includes conductors or conductors designated 1–8 and the conductors are inserted into the channels $44_1, \ldots, 44_8$ in the load bar housing 40, respectively. The channels $44_1$, $44_2$, $44_7$ and $44_8$ which are arranged at the longitudinally extending transverse edges of the load bar housing 40 thus receive the conductors designated 1, 2, 7 and 8, respectively. The passages $44_3$ and $44_6$ which are arranged immediately inward of passages $44_2$ and $44_7$, respectively, thus receive the conductors designated 3 and 6, respectively, and the passages $44_4$ and $44_5$ in the middle receive the conductors designated 4 and 5, respectively. As in known in the art, according to a standard terminating convention, conductors 4 and 5 operatively form conductor pair #1, conductors 1 and 2 form conductor pair #2, conductors 3 and 6 form conductor pair #3 and conductors 7 and 8 form conductor pair #4.

In view of the arrangement of the conductor-receiving passages 44 in three levels in the plug housing 12, the plug 10 includes three sizes of terminal blades 20 received in the terminal-receiving slots 18 (FIGS. 1 and 5). Terminal blades $20_3$,$20_6$ are the shortest and each is arranged in a respective one of the slots 18 communicating with passages $44_3$,$44_6$, terminal blades $20_4$,$20_5$ are the longest and each is arranged in a respective one of the slots 18 communicating with passages $44_4$,$44_5$, and terminal blades $20_1$,$20_2$,$20_7$ and $20_8$ have an intermediate length and each is arranged in a respective one of the slots 18 communicating with passages $44_1$,$44_2$,$44_7$,$44_8$.

By means of the load bar housing 14 in accordance with the invention, the entire portion of each of the conductors of the cable 8 within the plug housing 12 is positioned in a precise, pre-determined position, including at the location below the strain relief element 34. In this manner, a random arrangement of any portion of the conductors within the plug 10 is avoided. The position of the portion of each of the conductors which is to be engaged by the terminal blades 20 is also in a pre-determined position. Thus, in one preferred embodiment of a plug in accordance with the invention, the portion of each conductor between the location below the strain relief element 34 and the terminal blades 20 is fixed in position.

To terminate the cable 8 by means of the plug 10, a process described in U.S. patent application Ser. No. 09/246,165, filed Feb. 8, 1999 (incorporated by reference herein) may be used. In this process, two opposed longitudinal slits are made in the cable jacket to expose a length of the conductors at least as large as the length of the load bar housing 40. The conductors, which are usually in twisted pairs in the cable, are untwisted and pressed into the channels 44 in the load bar housing 40 in correspondence with the designation of the conductors, as in the conventional manner. The ends of the conductors extending beyond the load bar housing 40 are then cut flush with the front end of the load bar housing 40. The slit portions of the cable jacket are cut to extend only up to the slits 62. The conductive strips 48,50 may be arranged on the load bar housing 40 before or after the conductors of the cable are threaded into the load bar housing 40. In the alternative, conductive strips 48,50 may be incorporated into the load bar housing during the fabrication thereof. The load bar assembly 18 having the slit portions of the cable jacket alongside it is then inserted into the cavity 14 in the plug housing 12 until the step 60 abuts against the shoulder 60*a* in cavity 14. In this manner, the rearward portion 40*a* of the load bar housing 40 will be situated in the rearward portion 14*a* of the cavity 14, the intermediate portion 40*b* will be situated in intermediate portion 14*b* and the forward portion 40*c* will be situated in forward portion 14*c*. Since the cavity 14 is dimensioned to receive the load bar assembly 18 without clearance below the load bar assembly 18, and with some clearance above the load bar assembly 18, upon insertion of the load bar assembly 18 into the cavity 14, the slit portion of the cable jacket below the load bar assembly 18 causes an upward flex of the rearward portion 40*a* of the load bar housing 40, which flexure is enabled by the slits 62.

The terminal blades 20 in the terminal-receiving slots 16 in the plug housing 12 are then pressed into the conductors to pierce the insulation thereof and engage the metal cores therein. The terminal blades 20 may be pre-positioned in the slots 16 so that it is only necessary to press them into the conductors.

Simultaneously with the pressing of the terminal blades 20 into the conductors or thereafter, the strain relief element 34 is pressed inward or set to engage the slit portion of the cable jacket overlying the rearward portion of the load bar assembly 18 to thereby secure the cable 8 in connection with the plug 10. The pressing of the strain relief element 34 inward causes the rearward portion 40*a* of the load bar housing 40 to be pressed downward against the bottom surface of the cavity 14 thereby reducing the angle between the rearward portion 40*a* and intermediate portion 40*b* of the load bar housing 40. The rearward portion 40*a* will not be co-planar with the intermediate portion 40*b* in view of the presence of the cable jacket between the rearward portion 40*a* and the lower surface of the cavity 14.

It has been found that the positioning of the conductors in pre-determined positions below the strain relief element 34 provides consistent NEXT values between plugs having the same construction. By contrast, in conventional plugs in which the conductors are randomly arranged at the location below the strain relief element, when the strain relief element is pressed inward into the cable, the conductors in the cable remain in this random arrangement and even more so, the conductors are susceptible to additional random movement. This random arrangement of conductors results in inconsistent NEXT values for plugs having the same design.

A particular advantage of the construction of the plug housing 12 and load bar assembly 18 in accordance with the invention is that cables having different thicknesses of jackets and different diameter conductors can be terminated by the plug 10. For the conductors, the channels 44 are provided with a size equal to or larger than a relatively large diameter conductor so that smaller diameter conductors can also be positioned therein. For the different thicknesses of jackets, the height of the rearward portion 14*a* of the cavity 14 is provided with a size greater than the height of the load bar assembly 18 and twice the thickness of the jacket of a relatively large cable. As such, cables with smaller cable jackets and insulation sheaths can be used to surround the load bar whereby the strain relief element 34 would engage with the upper portion of the cable jacket and thereby fix the cable in connection with the plug 10.

The plug 10 described above may be used to terminate an end of a multi-conductor cable 8 (FIG. 1) whereby the other end of the cable is terminated by a similar plug or another modular connector and is left unterminated. A plug-cable assembly is thus formed.

Although the load bar housing 40 and plug housing 12 are designed to receive and terminate eight conductors, other load bars having a different number of channels 44 and plug housings having a corresponding number of terminal-receiving slots 16 could also be used applying the principles of the invention as described above.

Instead of providing two or three different substantially parallel levels of channels 44 in the load bar housing 40, a load bar housing in accordance with the invention may be constructed with more than three parallel levels of channels. That is, aside from providing in the load bar housing 40 the preferred maximal spacing between the channels receivable of the conductors designated 3 and 6 and the channels receivable of the conductors designated 4 and 5, the position of the remaining channels receivable of the conductors designated 1, 2, 7 and 8 is not required to be as shown in the illustrated embodiment, i.e., in a common level. For example, the channels receivable of conductors 1,2 may be at a different level than the channels receivable of conductors 7,8. Moreover, each channel receivable of conductors 1, 2, 7 and 8 may be at its own level, i.e., not defining a plane with another channel which is parallel to the plane in which the channels receivable of, e.g., conductors 3,6 are situated. In any of these proposed modifications, the terminal-receiving slots 16 and terminal blades would be dimensioned accordingly.

In another proposed modification of the plug described above, the cavity 14 does not extend to a location below the terminal-receiving slots 16. Thus, the cavity 14 includes only the rear portion 14*a* and the intermediate portion 14*b* and not the forward portion 14*c*. The load bar housing 40 is similarly formed to include only the rearward portion 40*a* and the intermediate portion 40*b* and not the forward portion 40*c*. In this case, the plug housing 12 is formed to include channels in alignment with the channels 44 in the load bar housing 40 and in communication with the terminal-receiving slots 16. During the assembly of the plug, the conductors would be cut flush with the front end of the load bar housing 40 and then pushed or threaded forwardly to extend beyond the front end of the load bar housing 40 a distance approximately equal to the length of the channels in the plug housing.

The use of the load bar housing 40 and load bar assembly 18 described above is not limited to the plug housing 12 described above and may be used in combination with other plug housings. The load bar housing 40 may also be used without the conductive strips 48,50, possibly with other means to ensure compliance with industry standards for electrical performance, in which case, the load bar housing 40 could be formed without the channel 52 and grooves 54*a*,54*b*. The other features of the load bar housing 40 would still be present.

Further, it is not required that the load bar assembly includes all three conductive strips 48,50. Rather, the load bar assembly 18 may include for example, only conductive strip 48 or only conductive strips 50.

Obviously, numerous modifications and variations of the present invention are possible in light of the above teachings. Accordingly, it is understood that other embodiments of the invention are possible in the light of the above teachings.

We claim:

1. A modular plug for terminating a cable having multiple conductors, comprising:

a housing defining a plurality of terminal-receiving slots and a longitudinal cavity extending from a rear surface of said housing, terminal blades arranged in said slots, and a load bar assembly including a load bar housing defining a plurality of conductor-receiving channels for receiving conductors of the cable and guiding the conductors to a location below said slots such that said terminal blades are displaceable to penetrate the conductors when the conductors are received in said channels, said channels in said load bar housing being arranged in at least three parallel levels, including first and second levels and a third level between said first and second levels, each level including at least two of said channels, wherein said channels in said second level are arranged between said channels in said first level in a transverse direction of said load bar assembly, and wherein the plug is an 8-position plug for positioning 8 conductors therein and said load bar includes eight channels for receiving conductors of a 8-conductor cable whereby the conductors are designated 1–8 and are positioned in sequence in said load bar housing, said channels arranged in said first level are arranged to receive the conductors designated 3 and 6, said channels in said second level are arranged to receive the conductors designated 4 and 5 and said channels in said third level are arranged to receive the conductors designated 1, 2, 7 and 8.

2. A modular plug for terminating a cable having multiple conductors, comprising:

a housing defining a plurality of terminal-receiving slots and a longitudinal cavity extending from a rear surface of said housing to a forward end of said housing in communication with said slots;

a load bar assembly including a load bar housing defining a plurality of conductor-receiving channels for receiving the conductors of the cable and holding the conductors at a location below said slots such that terminal blades are displaceable to penetrate the conductors when the conductors are received in said channels; said load bar having at least two portions, including a rearward portion and a forward portion forward of said rearward portion; and at least one transverse slit formed along one of an upper and a lower surface of said load bar between said forward portion and said rearward portion and structured and arranged to allow said rearward portion to flex with respect to said forward portion of said load bar;

said plurality of conductor-receiving channels being arranged in a plurality of substantially parallel spaced levels, each level including at least one pair of channels for receiving a pair of conductors forming a circuit pair during use.

3. A modular plug as recited in claim 2, wherein the channels of one of said channel pairs in a second level are situated inwardly of the channels of one of said channel pairs in a first level.

4. A modular plug as recited in claim 2, wherein said load bar assembly includes a conductive strip situated between the channels of one of said channel pairs.

5. A modular plug as recited in claim 2, wherein said load bar assembly includes at least one conductive member partially surrounding the channels of one of said channel pairs.

6. A modular plug as recited in claim 2, wherein said load bar assembly defines at least four pairs of conductor-receiving channels for receiving the conductors of four circuit pairs, respectively, one of said channel pairs being situated in a first level, one of said channel pairs being situated in a second level, and at least one of said channel pairs being situated in a third level between said first and second levels.

7. A modular plug as recited in claim 2, wherein said load bar assembly defines at least four pairs of conductor-receiving channels for receiving the conductors of four circuit pairs respectively, one of said channel pairs situated in a first level, and three of said channel pairs being situated in a second level.

8. A modular plug as recited in claim 7, wherein the channels of one of said channel pairs in said second level are situated inwardly of the channels of said one of said channel pairs in said first level.

9. A modular plug as recited in claim 8, wherein said load bar assembly includes a conductive strip situated between said channels of said channel pair situated in said first level.

10. A modular plug as recited in claim 7 wherein said load bar assembly includes a conductive strip situated between said channels of said channel pair situated in said first level.

11. The modular plug according to claim 2, wherein said at least one transverse slit comprises a pair of aligned transverse slits formed along said upper and lower surfaces of said load bar between said second forward portion and said first rearward portion.

12. A modular plug-cable assembly comprising:

a cable having multiple conductors including at least two pairs of conductors forming respective circuit pairs in use;

at least one plug terminating a respective end of said cable, each said plug including:

a housing defining a plurality of terminal-receiving slots and a longitudinal cavity extending from a rear surface of said housing;

terminal blades arranged in said slots;

a load bar assembly including a load bar defining a plurality of conductor-receiving channels for receiving conductors of the cable and holding the conductors at a location below said slots such that said terminal blades are displaceable to penetrate the conductors when the conductors are received in said channels; said load bar having a forward portion, an intermediate portion, and a rearward portion, each portion having a transverse cross-section different from the transverse cross-section of the other portions; and at least one transverse slit formed along one of an upper and a lower surface of said load bar between said intermediate portion and said rearward portion of said load bar and structured and arranged to allow said rearward portion to flex with respect to said intermediate portion of said load bar;

said plurality of conductor-receiving channels being arranged in a plurality of parallel spaced levels, each level including at least one pair of channels; and a first pair of conductors forming a circuit pair during use being received in a first pair of channels in a first level, and a second pair of conductors forming a circuit pair during use being received in a second pair of channels in a second level.

13. An assembly as recited in claim 12, wherein said channels of said second channel pair in said second level arc situated inwardly of the channels of said first channel pair in said first level.

14. An assembly as recited in claim 12, wherein said load bar assembly includes at least one conductive strip situated between the channels of said channel pair situated in said first level.

15. An assembly as recited in claim 12, wherein:

said cable includes at least four circuit pairs of conductors forming respective circuits during use; and wherein said load bar assembly defines at least four pairs of conductor-receiving channels for receiving the conductors of said four circuit pairs respectively, one of said channel pairs being situated in a first level, one of said channel pairs being situated in a second level, and two of said channel pairs being situated in a third level between said first and second levels; and wherein said conductors of one of said circuit pairs arc received in said channel pair in said first level;

said conductors of another one of said circuit pairs being received in said pair of channels in said second level; and wherein said conductors of said other two of said circuit pairs being received in said two pairs of channels in said third level.

16. The modular plug according to claim 12, wherein said at least one transverse slit comprises a pair of aligned transverse slits formed along said upper and lower surfaces of said load bar between said second forward portion and said first rearward portion.

17. An assembly as recited in claim 12, wherein:

said cable includes at least four pairs of conductors forming circuit pairs in use;

and wherein said load bar assembly defines at least four pairs of conductor-receiving channels for receiving the conductors of said four circuit pairs respectively, one of said channel pairs being situated in a first level, and three of said channel pairs being situated in a second level; and wherein said conductors of one of said circuit pairs are received in said pair of channels in said first level and said conductors of three of said circuit pairs are received in respective ones of said three pairs of channels in said second level.

18. An assembly as recited in claim 17, wherein said channels and conductors received therein of one said channels pairs in said second level are situated inwardly of the channels and conductors received therein of one of said channel pairs in said first level.

19. An assembly as recited in claim 18, wherein said load bar assembly includes a conductive strip situated between said channels of said channel pair situated in said first level.

20. An assembly as recited in claim 17, wherein said load bar assembly includes a conductive strip situated between said channels of said channel pair situated in said first level.

* * * * *